US009645540B2

(12) United States Patent
Iijima et al.

(10) Patent No.: US 9,645,540 B2
(45) Date of Patent: May 9, 2017

(54) BEARING MEMBER, END MEMBER, PHOTORECEPTOR-DRUM UNIT, AND PROCESS CARTRIDGE

(71) Applicant: MITSUBISHI CHEMICAL CORPORATION, Tokyo (JP)

(72) Inventors: Shinichi Iijima, Jurong (SG); Shuichi Ikeda, Odawara (JP)

(73) Assignee: MITSUBISHI CHEMICAL CORPORATION, Tokyo (JP)

( * ) Notice: Subject to any disclaimer, the term of this patent is extended or adjusted under 35 U.S.C. 154(b) by 0 days.

(21) Appl. No.: 14/866,713

(22) Filed: Sep. 25, 2015

(65) Prior Publication Data

US 2016/0018777 A1 Jan. 21, 2016

Related U.S. Application Data

(63) Continuation of application No. PCT/JP2014/058133, filed on Mar. 24, 2014.

(30) Foreign Application Priority Data

Mar. 26, 2013 (JP) ..... 2013-063794

(51) Int. Cl.
*G03G 15/00* (2006.01)
*G03G 21/16* (2006.01)
*G03G 21/18* (2006.01)

(52) U.S. Cl.
CPC ..... *G03G 15/757* (2013.01); *G03G 21/1647* (2013.01); *G03G 21/186* (2013.01)

(58) Field of Classification Search
USPC ..... 399/111
See application file for complete search history.

(56) References Cited

U.S. PATENT DOCUMENTS 6,907,205 B2 * 6/2005 Himes ..... G03G 15/757 399/117
8,615,184 B2 * 12/2013 Zhou ..... G03G 15/757 399/111
9,098,048 B2 * 8/2015 Huang ..... G03G 15/757
9,329,517 B2 * 5/2016 Morgan ..... G03G 15/00
(Continued)

FOREIGN PATENT DOCUMENTS

CN 102466998 A 5/2012
JP 39-2314 Y1 1/1964
(Continued)

OTHER PUBLICATIONS

International Search Report issued Jun. 10, 2014 in PCT/JP2014/058133 (with English language translation).
(Continued)

*Primary Examiner* — Clayton E Laballe
(74) *Attorney, Agent, or Firm* — Oblon, McClelland, Maier & Neustadt, L.L.P.

(57) ABSTRACT

There is provided a bearing member which is disposed at an end section of a photoreceptor drum for attaching a shaft member that transmits a rotating force to the bearing member, the bearing member including a tubular body, and a holding section which is disposed inside the tubular body attachably and detachably, and holds a rotating force transmission pin provided in the shaft member, wherein the holding section includes at least two swing grooves provided extending along an axial direction of the tubular body, and opposing each other, and introduction grooves, each having one end communicating with the swing groove and the other end communicating with an outside of the swing groove, and the introduction grooves in a posture in which the shaft member transmits the rotating force are disposed entirely at a position to be lower than an entirety or a part of the rotating force transmission pin.

14 Claims, 23 Drawing Sheets

(56) References Cited

U.S. PATENT DOCUMENTS

| | | | | |
|---|---|---|---|---|
| 2010/0034561 | A1* | 2/2010 | Batori | G03G 15/757 399/167 |
| 2010/0221036 | A1 | 9/2010 | Hara et al. | |
| 2010/0278559 | A1 | 11/2010 | Komatsu et al. | |
| 2011/0038649 | A1 | 2/2011 | Miyabe et al. | |
| 2011/0058851 | A1 | 3/2011 | Okabe | |
| 2011/0182619 | A1 | 7/2011 | Batori et al. | |
| 2011/0255900 | A1 | 10/2011 | Zhou et al. | |
| 2012/0243905 | A1* | 9/2012 | Uratani | G03G 21/186 399/111 |
| 2012/0294649 | A1 | 11/2012 | Kikuchi et al. | |
| 2013/0230337 | A1 | 9/2013 | Batori et al. | |
| 2013/0287437 | A1 | 10/2013 | Miyabe et al. | |
| 2014/0086632 | A1 | 3/2014 | Batori et al. | |
| 2014/0086633 | A1 | 3/2014 | Batori et al. | |
| 2014/0105639 | A1 | 4/2014 | Kikuchi et al. | |
| 2014/0112685 | A1* | 4/2014 | Komatsu | G03G 21/1825 399/111 |

FOREIGN PATENT DOCUMENTS

| | | | |
|---|---|---|---|
| JP | 45-1931 | Y1 | 1/1970 |
| JP | 2009-300516 | A | 12/2009 |
| JP | 2010-26473 | A | 2/2010 |
| JP | 2010-197893 | A | 9/2010 |
| JP | 2010-262056 | A | 11/2010 |
| JP | 2011-59338 | A | 3/2011 |
| JP | 2011-180578 | A | 9/2011 |
| TW | 201310179 | A1 | 3/2013 |

OTHER PUBLICATIONS

Written Opinion issued Jun. 10, 2014 in PCT/JP2014/058133 (with English language translation).

"Drive flange, photosensitive material drum unit, process cartridge, image forming apparatus, and method of manufacturing drive flange" Japan Institute of Invention and Innovation, Journal of Technical Disclosure, Technical Disclosure No. 2010-502200, Apr. 22, 2010, 91 Pages (with English language translation).

Extended European Search Report issued Feb. 15, 2016 in Patent Application No. 14774292.8.

Office Acton issued Dec. 6, 2016, in Japanese Application No. 2013-063794, filed Mar. 26, 2013 (with Machine translation).

* cited by examiner

BEARING MEMBER, END MEMBER, PHOTORECEPTOR-DRUM UNIT, AND PROCESS CARTRIDGE

CROSS REFERENCE TO RELATED APPLICATION(S)

This application is a continuation of International Patent Application No. PCT/JP2014/058133 filed on Mar. 24, 2014, claiming the benefit of priority of Japanese Patent Application No. 2013-063794 filed on Mar. 26, 2013, the contents of which are incorporated herein by reference in its entirety.

BACKGROUND OF THE INVENTION

1. Field of the Invention

The present invention relates to a process cartridge which is provided to be attachable to and detachable from an image forming apparatus, such as a laser printer or a copying machine, a photoreceptor-drum unit which is provided in the process cartridge, an end member which is mounted on a photoreceptor drum of the photoreceptor-drum unit, and a bearing member which configures the end member.

2. Description of the Related Art

In an image forming apparatus, such as a laser printer or a copying machine, a process cartridge which is attachable to and detachable from an image forming apparatus body (hereinafter, referred to as an "apparatus body") is provided.

The process cartridge is a member which forms contents to be expressed by letters or figures and transfers the contents to a recording medium, such as a paper sheet, and here, includes a photoreceptor drum in which the transferred contents are formed. Therefore, in the process cartridge, various means for forming the contents to be transferred to the photoreceptor drum are disposed together. Examples of these means include means for developing, means for charging the photoreceptor drum, and means for cleaning the photoreceptor drum.

In case of the process cartridge, the same process cartridge is attached to and detached from the apparatus body for maintenance, or a new process cartridge is mounted on the apparatus body by detaching an old process cartridge from the apparatus body in order to replace the process cartridge with a new process cartridge. Attaching and detaching the process cartridge in this manner is performed by users of the image forming apparatus manually, and it is desirable to easily perform attaching and detaching as much as possible from such a point of view.

However, a drive shaft of the apparatus body is engaged with the photoreceptor drum which is included in the process cartridge directly or via another member, and according to this, the photoreceptor drum receives a rotating force from the drive shaft and rotates. Therefore, in order to attach and detach the process cartridge to and from the apparatus body, it is necessary to release (detach) the engagement between the drive shaft of the apparatus body and the photoreceptor drum, and to reengage (mount) the process cartridge again.

Here, if it is possible to move the photoreceptor drum (process cartridge) in a direction of an axial line of the drive shaft of the apparatus body, and to attach and detach the photoreceptor drum, configuring an apparatus for this can be relatively easy. However, from the viewpoint of reducing the size of the image forming apparatus or ensuring space for the attachment and detachment of the process cartridge, it is preferable that the process cartridge is detached from the apparatus body and falls out in a direction which is different from the axial line direction of the drive shaft, and that mounting the process cartridge to the apparatus body is done by pushing in this direction.

In JP-A-2010-26473 as Patent Literature 1, a structure for attaching and detaching a process cartridge in a direction which is different from an axial line direction of a drive shaft of an apparatus body is disclosed. Specifically, a coupling member (shaft member) which is disclosed in JP-A-2010-26473 as Patent Literature 1 is swingably attached to a drum flange (bearing member) by providing a spherical section. Therefore, a part (rotating force receiving member) which is provided in the coupling member and engages with the drive shaft of the apparatus body can swing around the spherical section, an angle with respect to the axial line of the photoreceptor drum can be changed, and engagement and disengagement between the drive shaft of the apparatus body and the photoreceptor drum become easier.

In addition, in Japan Institute of Invention and Innovation Journal of Technical disclosure, Japan Institute for Promoting Invention and Innovation No. 2010-502200 as Non Patent Literature 1, a structure in which a groove for attaching a rotating force transmission pin provided in a shaft member to a bearing member is provided in a rotating direction of an inner circumference of the bearing member, and attachment of the rotating force transmission pin to the bearing member is easily performed due to the groove, is disclosed.

Patent Literature 1: JP-A-2010-26473

Non Patent Literature 1: Japan Institute of Invention and Innovation Journal of Technical disclosure, Japan Institute for Promoting Invention and Innovation No. 2010-502200

SUMMARY OF THE INVENTION

However, in the structure of the coupling member (shaft member) described in JP-A-2010-26473 and the drum flange (bearing member) for holding the coupling member, in order to make a structure in which the spherical section is held by the drum flange while allowing the coupling member to swing, it is necessary to forcibly pull in and out the spherical section when attaching the spherical section to the drum flange (bearing member). In assembling the spherical section by forcibly pulling in and out, there is a concern that assembly precision deteriorates or components are damaged during assembly.

In addition, in JP-A-2010-26473, a method for assembling other components of the coupling member in order after positioning a part of the components by decomposing the coupling member to the drum flange (bearing member), is also described. According to this, there are no issues, such as the forcible pulling in and out, but there are still the issues of man-hours increasing, and productivity deteriorating. In addition, it is difficult to attach the drum flange (bearing member), in which the coupling member (shaft member) that swings in such a manner is attached, to an end section of the photoreceptor drum with high precision. In addition, it takes a lot of effort and time to remove the shaft member from the bearing member when the shaft member is reused.

It is easy to attach the shaft member to and detach the shaft member from the bearing member in the technology described in Japan Institute of Invention and Innovation Journal of Technical disclosure, Japan Institute for Promoting Invention and Innovation No. 2010-502200, but there is a concern that the shaft member is detached from the bearing member without intention. In addition, there is a case where it is difficult to realize smooth swinging of the shaft member and smooth attachment and detachment of the shaft member from the apparatus body.

Here, in consideration of the above-described problems, a non-limited object of the present invention is to provide a bearing member, which can be easily produced by suppressing issues, such as damage, with high precision, while it is possible to prevent the shaft member from being unintentionally detached, to allow the shaft member to smoothly swing, to transmit a rotating force, and to attach and detach the shaft member to and from the apparatus body. In addition, there are provided an end member which is provided with the bearing member, a photoreceptor-drum unit, and a process cartridge.

Hereinafter, non-limited aspects of the present invention will be described. Here, reference numerals in the drawings are written in parentheses in order to make it easy to understand, but the present invention is not limited thereto.

In the present invention, there is provided a bearing member (45, 145) which is disposed at an end section of a photoreceptor drum (35) for attaching a shaft member (70) that transmits a rotating force to the bearing member, the bearing member including: a tubular body (46); and a holding section (50, 150) which is disposed inside the tubular body attachably and detachably, and holds a rotating force transmission pin (95) provided in the shaft member, wherein the holding section includes at least two swing grooves (51*b*, 55*b*) provided extending along an axial direction of the tubular body, and opposing each other, and introduction grooves (51*a*, 55*a*), each having one end communicating with the swing groove and the other end communicating with an outside of the swing groove, and wherein, where a side in which the shaft member is inserted in the baring member is considered as an upper side, the introduction grooves in a posture in which the shaft member transmits the rotating force are disposed entirely at a position to be lower than an entirety or a part of the rotating force transmission pin.

According to an aspect of the bearing member (45, 145) of the present invention, the holding section (50, 150) includes a bias member (69, 169) of which one end side is attached to the tubular body (46), and which can be biased in the axial direction.

According to an aspect of the bearing member (45, 145) of the present invention, the bias member (69) is a coil spring.

According to an aspect of the bearing member (45, 145) of the present invention, the bias member (169) is an elastic rubber.

According to an aspect of the bearing member (45) of the present invention, a movable base (60) is disposed on the other end side of the bias member (69), and the movable base can move in the axial direction of the tubular body.

In the present invention, there is provided an end member (40, 140) including a shaft member (70); and a bearing member (45, 145) of the present invention, wherein the shaft member includes a rotating shaft (85), a rotating force receiving section (71) which is provided on one end side of the rotating shaft, is engageable with a rotating force imparting section of an image forming apparatus body, and receives a rotating force from a drive shaft in an engaged posture, a base end section (90) which is disposed on the other end side of the rotating shaft, and a rotating force transmission pin (95) which has an end section that protrudes from the base end section, wherein the shaft member is combined with the bearing member as the rotating force transmission pin of the shaft member is disposed in the swing groove (51*b*, 55*b*) of the bearing member, and wherein, where a side in which the shaft member is inserted in the bearing member is considered as an upper side, at least a part of the rotating force transmission pin in a posture in which the shaft member transmits the rotating force is disposed above the introduction grooves (51*a*, 55*a*).

In the present invention, there is provided an end member (40) including a shaft member (70) and a bearing member (45) of the present invention, wherein the shaft member includes a rotating shaft (85), a rotating force receiving section (71) which is provided on one end side of the rotating shaft, is engageable with a rotating force imparting section of an image forming apparatus body, and receives a rotating force from a drive shaft in an engaged posture, a base end section (90) which is disposed at the other end side of the rotating shaft, and a rotating force transmission pin (95) which has an end section that protrudes from the base end section, wherein the shaft member is combined with the bearing member and the base end section is disposed being in contact with a movable base (60) as the rotating force transmission pin of the shaft member is disposed in the swing groove (51*b*, 55*b*) of the bearing member, and wherein, where a side in which the shaft member is inserted in the bearing member is considered as an upper side, at least a part of the rotating force transmission pin in a posture in which the shaft member transmits the rotating force is disposed above the introduction grooves (51*a*, 55*a*).

According to an aspect of the end member (40, 140) of the present invention, movement of the shaft member (70) in an axial direction is regulated by the rotating force transmission pin (95).

According to an aspect of the end member (40, 140) of the present invention, in the base end section (90), movement of the shaft member in a falling-out direction in the axial direction is regulated by the bearing member (45, 145).

In the present invention, there is provided a photoreceptor-drum unit (30) including a photoreceptor drum (35); and the end member (40, 140) of the present invention.

In the present invention, there is provided a process cartridge (20) including the photoreceptor-drum unit (30) of the present invention, in which a shaft member (70) is attachable to and detachable from a drive shaft of an image forming apparatus (10).

According to the present invention, it may be easy to attach the shaft member to the bearing member, the shaft member swings smoothly after the attachment, and it is possible to prevent the shaft member from unintentionally falling out. In addition, it is possible to transmit a rotational driving force from the apparatus body to the photoreceptor drum, and it is also easy to attach and detach the process cartridge to and from the apparatus body.

In addition, since it is possible to easily attach and detach the shaft member to and from the bearing member, before attaching the swinging shaft member to the bearing member, attachment of the bearing member to the photoreceptor drum is more appropriately performed compared to the related art.

According to this, when the shaft member is attached to the bearing member, since it is not necessary to strongly attach and detach the shaft member, accuracy of assembly of the shaft member and the bearing member does not deteriorate.

DETAILED DESCRIPTION OF THE EXEMPLARY EMBODIMENTS

Figure 1:
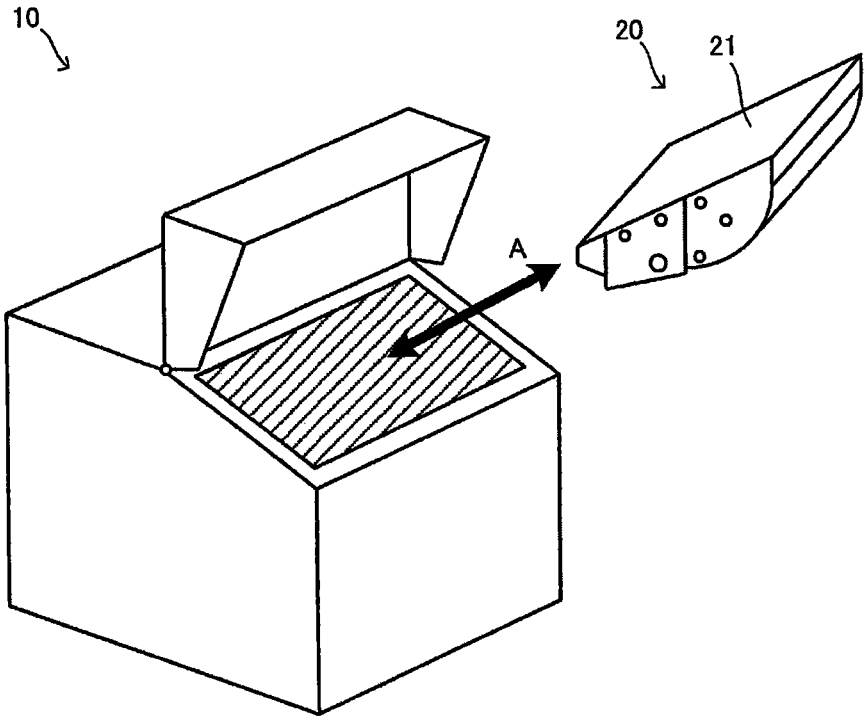
FIG. 1 is a schematic view of an image forming apparatus body and a process cartridge.

The above-described effects and advantages of the present invention are apparent from the embodiments for implementing the invention which will be described in the following. Hereinafter, the present invention will be described based on the embodiments illustrated in the drawings. However, the present invention is not limited to the embodiments.

FIG. 1 is a diagram illustrating one embodiment, and is a perspective view schematically illustrating a process cartridge 20 which is provided with a bearing member 45 (refer to FIG. 2A), and an image forming apparatus body 10 (hereinafter, there is a case where the image forming apparatus body 10 is described as an "apparatus body 10") which has the process cartridge 20 mounted thereon for use. The process cartridge 20 illustrated in FIG. 1 can be mounted onto and detached from the apparatus body 10 by being moved in a direction illustrated with A in FIG. 1. The direction is a direction which is different from an axial line direction of a drive shaft of the apparatus body 10. In addition, the apparatus body 10 and the process cartridge 20 configure the image forming apparatus, and hereinafter, will be described in detail.

The process cartridge 20 includes a housing 21 which forms an outline of the process cartridge 20, and various components inside thereof. Specifically, in the embodiment, in addition to a photoreceptor-drum unit 30 (refer to FIG. 2A), a charging roller, a developing roller, a developing blade, a transfer roller, and a cleaning blade are provided.

Figure 2A:
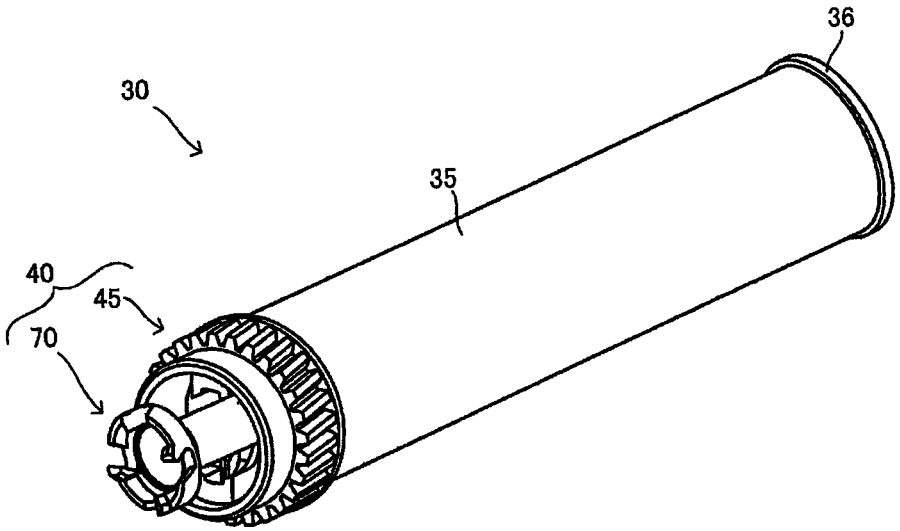
FIG. 2A is a perspective view of an external appearance of a photoreceptor-drum unit according to one embodiment.
Figure 2B:
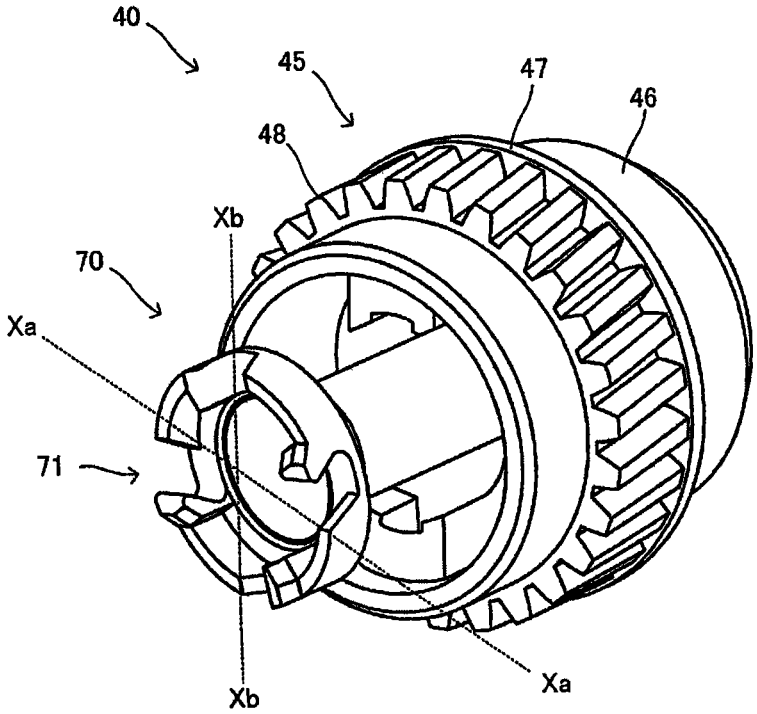
FIG. 2B is a perspective view of an external appearance of an end member.

In the photoreceptor-drum unit 30, letters or figures to be transferred to a recording medium, such as a paper sheet, are formed. FIG. 2A illustrates a perspective view of an external appearance of the photoreceptor-drum unit 30. As can be ascertained from FIG. 2A, the photoreceptor-drum unit 30 is provided with a photoreceptor drum 35, a lid member 36, and an end member 40. FIG. 2B is a perspective view focusing on the end member 40. Hereinafter, with reference to FIGS. 2A and 2B and appropriate drawings, the photoreceptor-drum unit 30 will be described.

The photoreceptor drum 35 is a member which is covered with a photoreceptor layer on an outer circumferential surface of a drum cylinder which has a cylindrical shape. In other words, the drum cylinder is covered with the photoreceptor layer on a conductive cylinder, such as aluminum.

The end member 40 is attached to one end of the photoreceptor drum 35 as will be described later, and the lid member 36 is disposed at the other end. In the embodiment, the drum cylinder has a cylindrical shape, but may have a solidly columnar shape. However, at least the lid member 36 and the end member 40 are formed to be appropriately attached to the end sections of the drum cylinder.

The lid member 36 is a member which is formed of a resin, and a fitting section which is inserted to the inside of the cylinder of the photoreceptor drum 35, and a bearing section which is disposed to cover one end surface of the photoreceptor drum 35 are formed coaxially. The bearing section has a shape of a disk which covers the end surface of the photoreceptor drum 35, and is provided with a part that receives a shaft. In addition, an earth plate which is made of a conductive material is disposed in the lid member 36, and according to this, the photoreceptor drum 35 and the apparatus body 10 are electrically connected to each other.

In addition, in the embodiment, an example of the lid member is described, but the lid member is not limited thereto, and it is possible to employ a lid member which can be generally obtained according to another embodiment. For example, a gear for transmitting a rotating force to the lid member may be disposed.

In addition, the above-described conductive material may be provided on the end member 40 side which will be described later.

The end member 40 is a member which is attached to the end section on a side opposite to the lid member 36 among the end sections of the photoreceptor drum 35, and is provided with a bearing member 45 and a shaft member 70.

Figure 3:
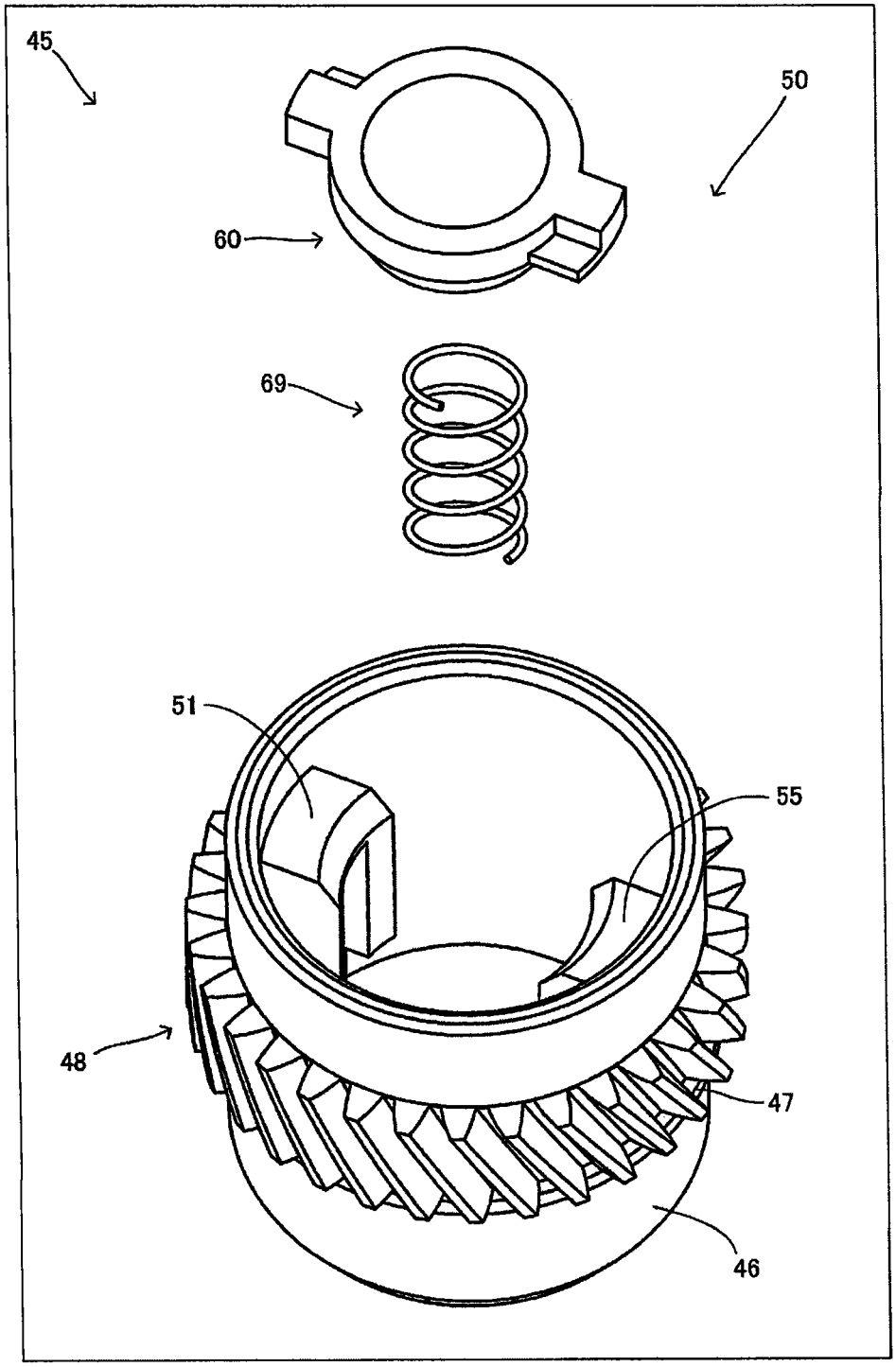
FIG. 3 is an exploded perspective view of a bearing member.
Figure 4:
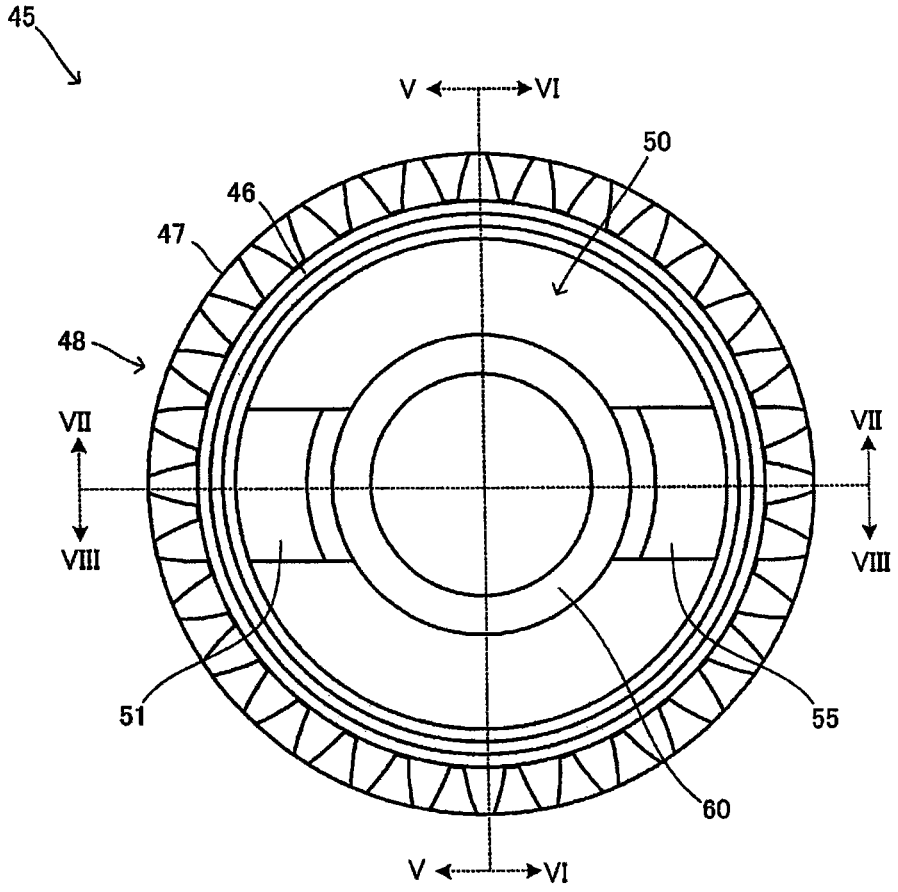
FIG. 4 is a view when the bearing member is viewed from an axial direction.
Figure 5A:
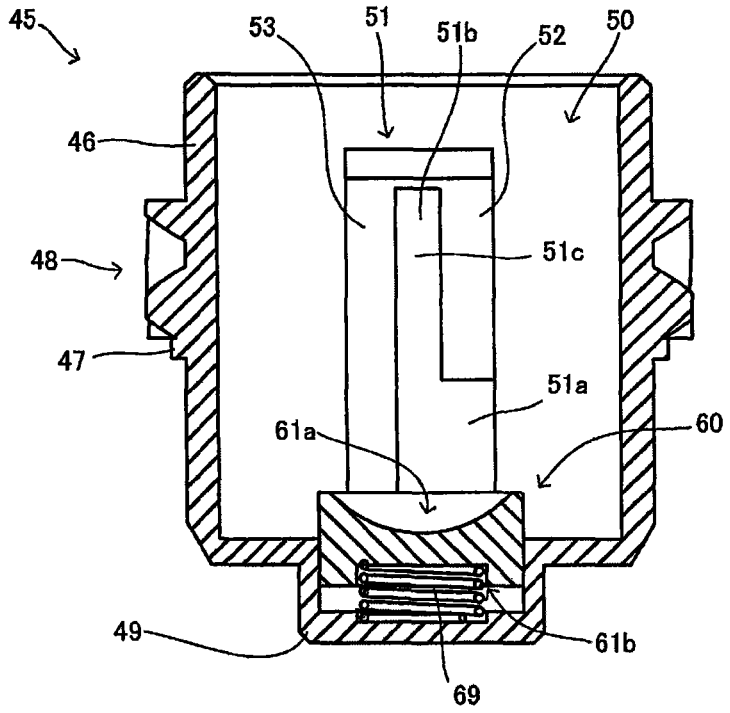
FIG. 5A is an arrow sectional view along line V-V of FIG. 4, and illustrates a posture in which a movable base is moved to a receiving section side.
Figure 5B:
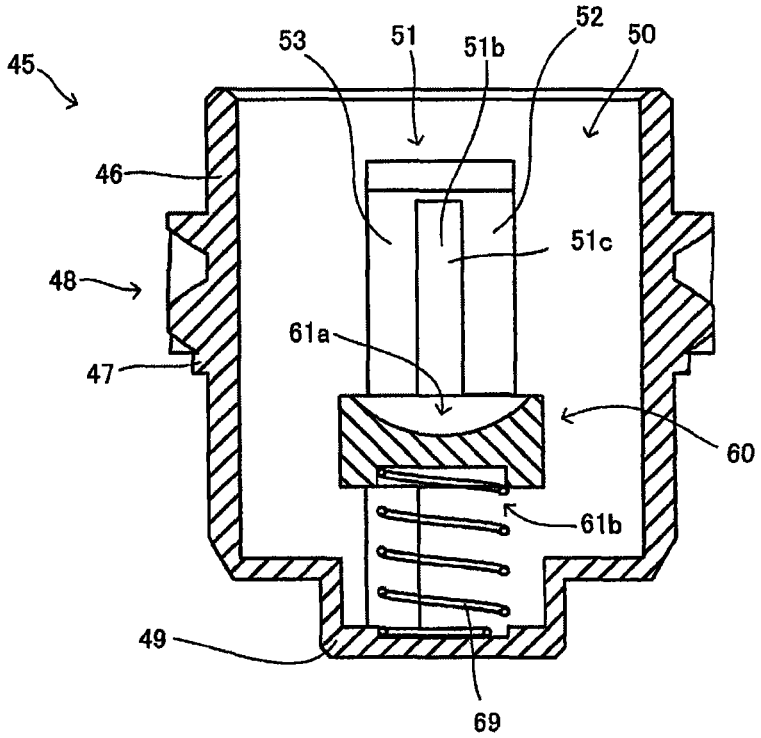
FIG. 5B is an arrow sectional view along line V-V of FIG. 4, and illustrates a posture in which the movable base is separated from the receiving section side.
Figure 6A:
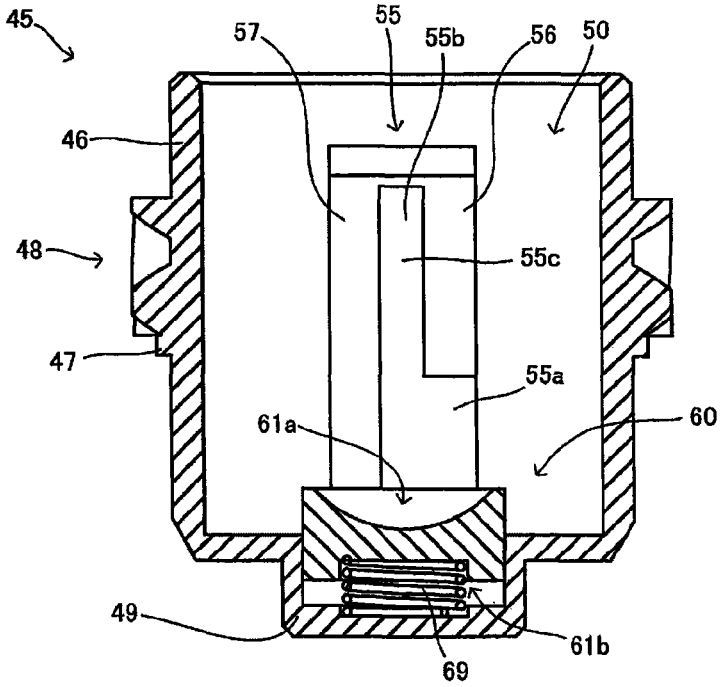
FIG. 6A is an arrow sectional view along line VI-VI of FIG. 4, and illustrates a posture in which the movable base is moved to a receiving section side.
Figure 6B:
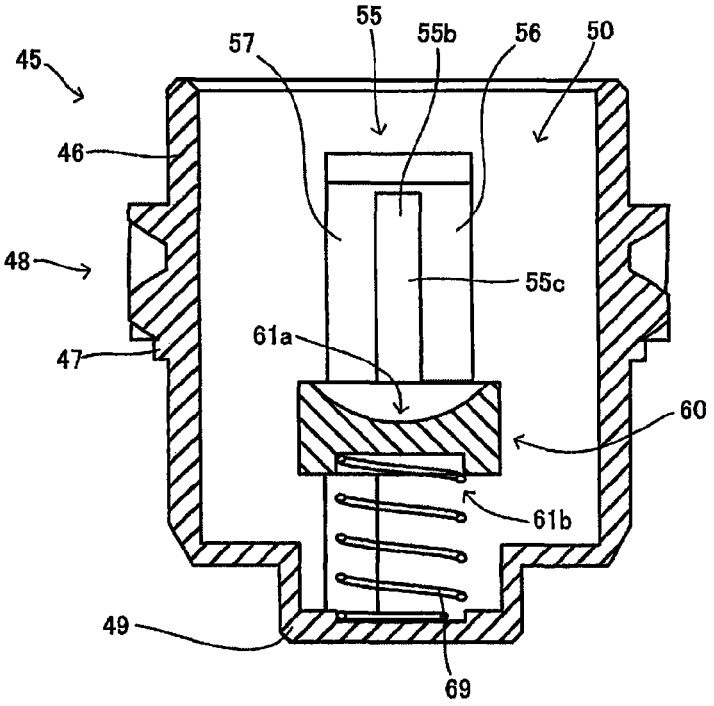
FIG. 6B is an arrow sectional view along line VI-VI of FIG. 4, and illustrates a posture in which the movable base is separated from the receiving section side.
Figure 7A:
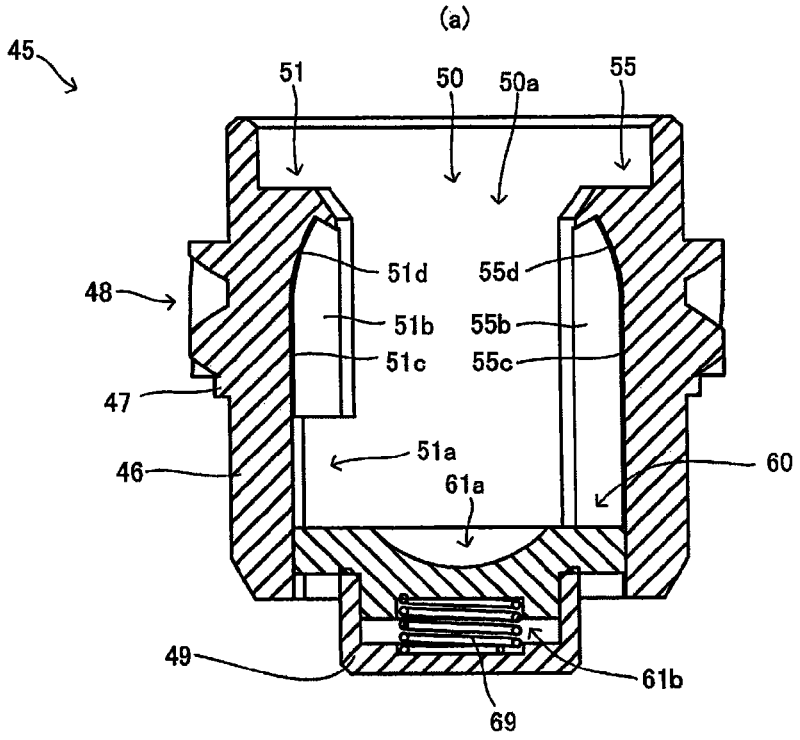
FIG. 7A is an arrow sectional view along line VII-VII of FIG. 4, and illustrates a posture in which the movable base is moved to a receiving section side.
Figure 7B:
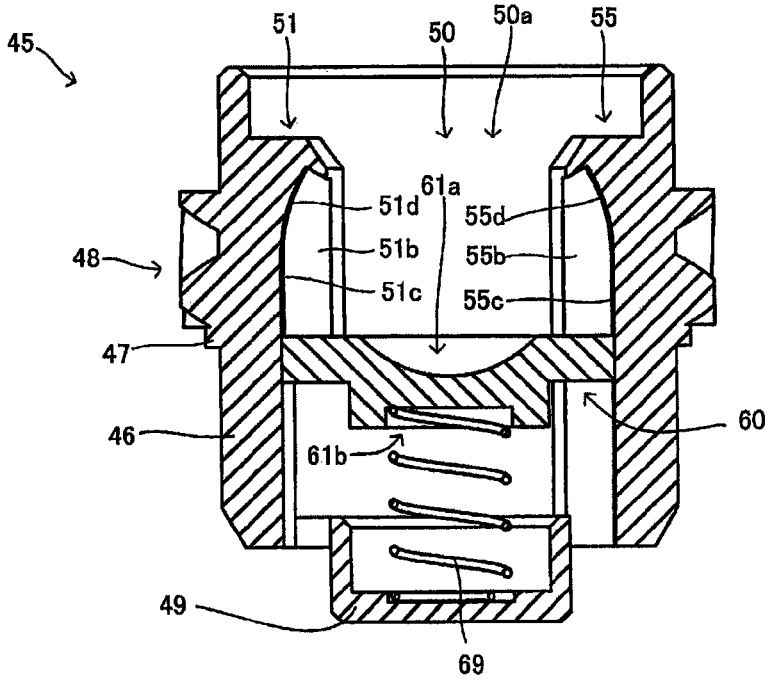
FIG. 7B is an arrow sectional view along line VII-VII of FIG. 4, and illustrates a posture in which the movable base is separated from the receiving section side.
Figure 8A:
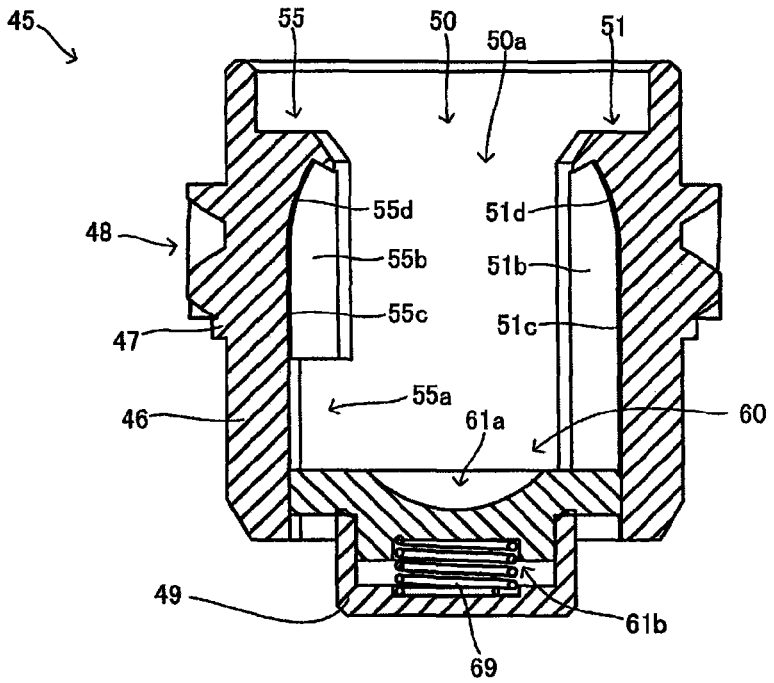
FIG. 8A is an arrow sectional view along line VIII-VIII of FIG. 4, and illustrates a posture in which the movable base is moved to the receiving section side.
Figure 8B:
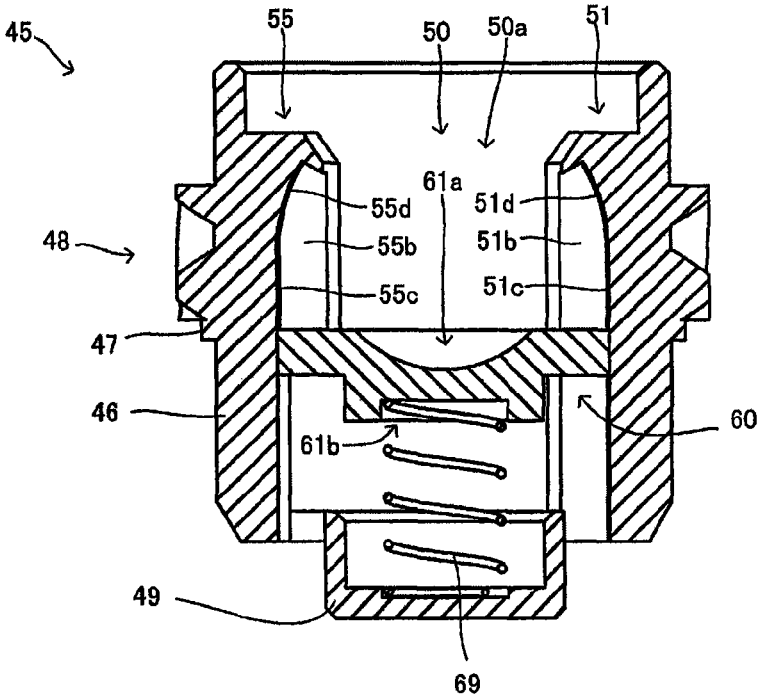
FIG. 8B is an arrow sectional view along line VIII-VIII of FIG. 4, and illustrates a posture in which the movable base is separated from the receiving section side.

The bearing member 45 is a member which is fixed to the end section of the photoreceptor drum 35. FIG. 3 is an exploded perspective view of the bearing member 45. In addition, FIG. 4 is a plan view when the bearing member 45 is viewed from the axial direction (side in which the shaft member 70 is inserted). Furthermore, FIGS. 5A and 5B are arrow sectional views illustrated with line V-V in FIG. 4, FIGS. 6A and 6B are arrow sectional views illustrated with line VI-VI in FIG. 4, FIGS. 7A and 7B are arrow sectional views illustrated with line VII-VII in FIG. 4, and FIGS. 8A and 8B are arrow sectional views illustrated with line VIII-VIII in FIG. 4. In FIGS. 5A to 8B, respectively, A is a situation in which a movable base 60 is pressed, a bias member 69 is compressed, and the movable base 60 is lowered, and B is a situation in which the bias member 69 extends by a biasing force, and the movable base 60 moves to be separated from a receiving section 49.

In the embodiment, as can be ascertained from FIGS. 2A to 8, the bearing member 45 is provided with a tubular body 46 which has a cylindrical shape. In addition, on an outer circumferential surface of the tubular body 46, a contact wall 47 which has a shape of a ring that stands along the outer circumferential surface, and a gear 48 are formed. An outer diameter of the tubular body 46 is generally the same as an inner diameter of the photoreceptor drum 35, and the bearing member 45 is fixed to the photoreceptor drum 35 by putting one end side of the tubular body 46 into the photoreceptor drum 35 and making the one end side fit to the photoreceptor drum 35. At this time, the end surface of the photoreceptor drum 35 is inserted until the end surface reaches a part having a depth at which the end surface abuts the contact wall 47. At this time, an adhesive may be used for more solid attachment. In addition, a groove or a bumpy part may be provided in the tubular body 46 of a part where the adhesive is disposed. Accordingly, the adhesive is held in the groove or a concave section, and further, solid adhesion between the bearing member 45 and the photoreceptor drum 35 is possible.

The gear 48 is a gear which transmits the rotating force to another roller, such as a developing roller, and is a helical gear. A type of the gear is not particularly limited, and may be a spur gear. However, the gear is not necessarily provided.

In an opening section on one end side of the tubular body 46 in the axial direction, the receiving section 49 is provided to cover at least a part of the opening section of the tubular body 46. In the embodiment, as can be ascertained from FIGS. 5A to 8B, the receiving section 49 has the shape of a container which has a concave section, and is configured so that one end side of the bias member comes into contact with the receiving section 49 and can be held. In addition, a holding section 50 is included inside the tubular body 46. Meanwhile, the end section on the side opposite to the receiving section 49 in the tubular body 46 is opened, and from here, the shaft member 70 is attached.

The holding section 50 is a part for forming predetermined introduction grooves 51*a* and 55*a*, and swing grooves 51*b* and 55*b* inside the tubular body 46, and include a first groove-formed section 51 and a second groove-formed section 55. Furthermore, the holding section 50 is provided with the movable base 60 and the bias member 69.

In the embodiment, a case where the holding section 50 is provided with two (one pair) groove-formed sections (51, 55) provided opposing each other is described, but being not limited thereto, four (two pairs) groove-formed sections, or six (three pairs) groove-formed sections may be provided, and more number of groove-formed sections may be provided.

The first groove-formed section 51 is a part for forming the introduction groove 51*a* and the swing groove 51*b*. As can be ascertained from FIGS. 3, 4, 5, 7, and 8, the first groove-formed section 51 has a first convex section 52 and a second convex section 53 which have a shape of two blocks to protrude from an inner circumferential surface of the tubular body 46. Any of the first convex section 52 and the second convex section 53 is aligned at a predetermined interval along a circumferential direction of the tubular body 46 by considering a direction along the axial direction of the tubular body 46 as a longitudinal direction. This void becomes the swing groove 51*b*. Accordingly, the swing groove 51*b* is a groove which extends along the axial direction of the tubular body 46. Furthermore, as can be ascertained from FIGS. 7A and 8A, on a bottom surface 51*c* of the swing groove 51*b*, a curved surface 51*d* which is curved with respect to a direction along the axial direction of the tubular body 46 is provided on the end section side opposite to the receiving section 49, and the curved surface 51*d* has a shape of an arc in the embodiment. In addition, due to the curved surface 51*d* and an opposing curved surface 55*d* of a bottom surface 55*c* of the swing groove 55*b*, the interval between the bottoms of the swing groove becomes narrow.

In addition, in the first convex section 52, the introduction groove 51*a* which cuts out the first convex section 52 along the circumferential direction of the tubular body 46 to the receiving section 49 side, and makes one end and the other end thereof communicate with each other is provided. Therefore, by providing the introduction groove 51*a*, a groove which communicates with the opposite side (outer side of the holding section 50) from the swing groove 51*b* is formed while interposing the first convex section 52 therebetween.

The second groove-formed section 55 is provided at a position which opposes the opposite side of the tubular body 46 in a radial direction with respect to the first groove-formed section 51.

The second groove-formed section 55 is a part which forms the introduction groove 55*a* and the swing groove 55*b*. As can be ascertained from FIGS. 3, 4, 6, 7, and 8, the second groove-formed section 55 has a first convex section 56 and a second convex section 57 which have a shape of two blocks that protrude from the inner circumferential surface of the tubular body 46. Any of the first convex section 56 and the second convex section 57 is also aligned at a predetermined interval along a circumferential direction of the tubular body 46 by considering a direction along the axial direction of the tubular body 46 as a longitudinal direction. This void becomes the swing groove 55*b*. Accordingly, the swing groove 55*b* is a groove which extends along the axial direction of the tubular body 46. Furthermore, as can be ascertained from FIGS. 7A and 8A, on the bottom surface 55*c* of the swing groove 55*b*, the curved surface 55*d* which is curved with respect to a direction along the axial direction of the tubular body 46 is provided on an end section side opposite to the receiving section 49, and the curved surface 55*d* has a shape of an arc in the embodiment. In addition, due to the curved surface 55*d* and the opposing curved surface 51*d* of the bottom surface 51*c* of the swing groove 51*b*, the interval between the bottoms of the swing groove becomes narrow. It is preferable that the arc of the curved surface 55*d* is included in the same circle as a circle in which the above-described arc of the curved surface 51*d* of the swing groove 51*b* is included.

Therefore, in the embodiment, as illustrated in FIGS. 7A and 8A, the interval between the bottom surface 51*c* and the bottom surface 55*c* on a sectional surface in the axial direction which includes the bottom surfaces 51*c* and 55*c* is formed to become narrow between the curved surface 51*d* and the curved surface 55*d* on the end section side in which the shaft member 70 is inserted (refer to FIG. 8A).

In addition, in the first convex section 56, the introduction groove 55*a* which cuts out the first convex section 56 along the circumferential direction of the tubular body 46 and makes one end and the other end thereof communicate each other. Therefore, by providing the introduction groove 55*a*, a groove which communicates with the opposite side (outer side of the holding section 50) from the swing groove 55*b* is formed while interposing the first convex section 56 therebetween.

Figure 9A:
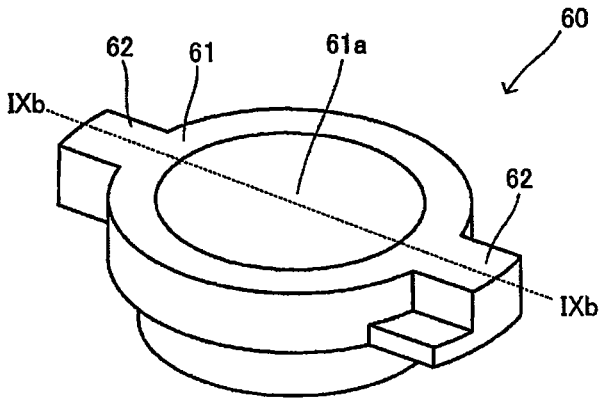
FIG. 9A is a perspective view.
Figure 9B:
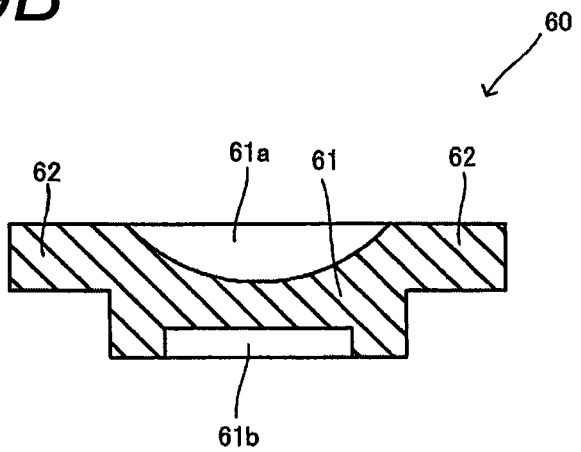
FIG. 9B is a sectional view of the movable base.

The movable base 60 is a member which is configured to be disposed to be movable inside the tubular body 46, and to receive a spherical body 90 (refer to FIGS. 10A and 10B) of the shaft member 70. In FIGS. 3 to 8, the movable base 60 from each viewpoint of shape is illustrated. In addition, in FIGS. 9A and 9B, an aspect of the movable base 60 is illustrated. FIG. 9A is a perspective view, and FIG. 9B is a sectional view in the axial direction along line illustrated with IXb-IXb in FIG. 9A.

As illustrated in the drawings, the movable base 60 is provided with a body 61 which has a shape of a disk and a predetermined thickness, and a hollow 61*a* in which a bottom section is a spherical surface is formed on one surface thereof. Since the spherical body 90 of the shaft member 70 comes into contact with the movable base 60 as will be described later, it is preferable that the spherical surface of the hollow 61*a* is a surface along the spherical surface of the spherical body 90. In addition, a columnar concave section 61*b* is formed on the other surface of the body 61. Here, as will be described later, one end of the bias member 69 is held.

Furthermore, from a part of the outer circumferential surface which is an edge part of the body 61, a guide section 62 is provided to protrude to the outer side in the radial direction from one side and the other side in the radial direction of the body 61. The guide section 62 is disposed inside the swing grooves 51*b* and 55*b* as will be described later, and has a size which makes it possible to move in the swing grooves 51*b* and 55*b*.

In addition, a movable base may be employed as long as the movable base comes into contact with and receives the base end section of the shaft member, and the hollow having the spherical surface is not necessarily provided as described in the embodiment. A hollow according to another embodiment may be employed, or a hollow itself may not be provided. Furthermore, instead of the hollow, a concave part can be employed.

The bias member 69 is means which can bias the tubular body in the axial direction, and biases the shaft member 70 in the axial direction when the shaft member 70 is combined with the bearing member 45. In the embodiment, as illustrated from each viewpoint in FIGS. 3 to 8, since the shaft member 70 is biased via the movable base 60, the movable base 60 is biased in the axial direction of the tubular body 46 in accordance with the movement of the movable base 60. In the embodiment, as can also be ascertained from FIGS. 3 to 8, the bias member is a so-called coil spring.

However, as will be described later, the bias member is not particularly limited to the specific aspect if the bias member can bias and hold the movable base 60, and for example, a member which uses an elastic material, such as elastic rubber, may be used.

The movable base 60 and the bias member 69 described above are disposed as follows inside the tubular body 46, and function as a part of the holding section 50. In other words, as can be ascertained from FIGS. 5A to 8B, the movable base 60 is disposed inside the tubular body 46 so that the concave section 61*b* faces the receiving section 49 side, and the hollow 61*a* faces an opening section on a side opposite to the receiving section 49 in the tubular body 46. At this time, as can be ascertained from FIGS. 7B and 8B, the protruded guide sections 62 of the movable base 60 are respectively inserted into the swing groove 51*b* of the first groove-formed section 51, and into the swing groove 55*b* of the swing groove 55 of the second groove-formed section 55. Attachment of the movable base 60 to the tubular body 46 can be performed in a similar order to the attachment of the shaft member 70 to the bearing member 45 which will be described later.

In addition, the bias member 69 is disposed between the receiving section 49 and the movable base 60 of the tubular body 46, one end side in a biasing direction comes into contact with or fixed to, and is held to the receiving section 49, and the other end side in the biasing direction is disposed in the concave section 61*b* of the movable base 60, and comes into contact with or fixed, and is held to the inside of the concave section 61*b*.

As the movable base 60 and the bias member 69 are disposed as described above, the movable base 60 and the bias member 69 can take a posture as follows. In other words, by pressing the movable base 60 to the receiving section 49 side against the biasing force of the bias member 69, as illustrated in A in FIGS. 5A to 8B, the bias member 69 is compressed and the movable base 60 approaches the receiving section 49 side. At this time, as can be ascertained from the drawings, the introduction groove 51*a* and the introduction groove 55*a* are illustrated to be closer to the opening side (an upper side of a paper surface of FIGS. 5A to 8B, that is, a side opposite to a side on which the bias member 69 is disposed in the movable base 60) than the movable base 60, and any member can pass through here.

Meanwhile, when a pressing force with respect to the movable base 60 is eliminated or weakened, as illustrated in B in FIGS. 5A to 8B, the bias member 69 extends, and the movable base 60 is separated from the receiving section 49 side, and approaches the opening side. At this time, as can be ascertained from the drawings, the size of the introduction groove 51*a* and the introduction groove 55*a* on the opening side (the upper side of the paper surface of FIGS. 5A to 8B, that is, the side opposite to the side on which the bias member 69 is disposed in the movable base 60) is hidden by the movable base 60 and becomes smaller than the size at the movable base 60. Accordingly, as will be described later, a rotating force transmission pin 95 cannot pass through the introduction groove 51*a* and the introduction groove 55*a*.

As described above, the holding section 50 is configured to form a space (space 50*a*) which is surrounded by the first groove-formed section 51, the second groove-formed section 55, and the movable base 60, as illustrated with 50*a* in FIGS. 7B and 8B. As will be described later, the spherical body 90 of the shaft member 70 is disposed in the space 50*a*. A relationship with the shaft member 70 will be described later in detail.

A material which configures the tubular body of the bearing member 45, the first groove-formed section 51, the second groove-formed section 52, and the movable base 60 are not particularly limited, but resin made of polyacetal, polycarbonate, or PPS can be used. Here, in order to improve rigidity of the member, glass fibers, carbon fibers, or the like, may be mixed in the resin in accordance with a loading torque. In addition, in order to attach the shaft member and smoothly perform a swinging operation, sliding properties may be improved by containing at least one of fluorine, polyethylene, and silicon rubber in the resin. In addition, the resin may be coated with fluorine, and may be coated with a lubricant.

Figure 10A:
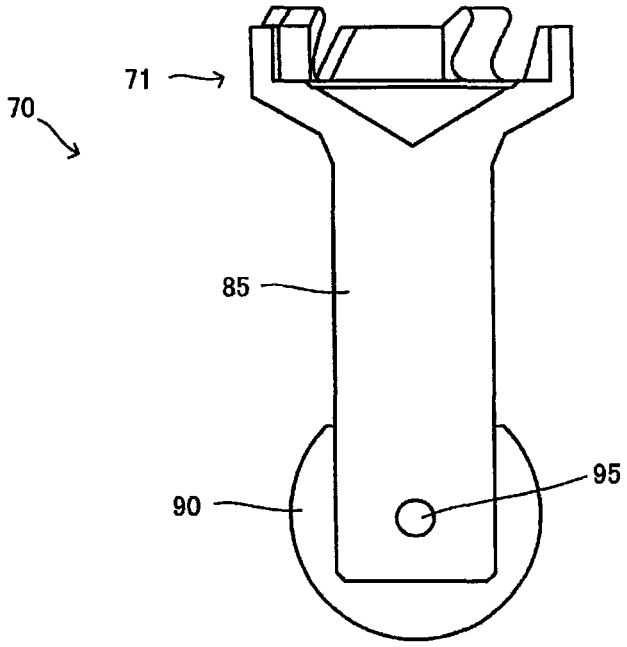
FIG. 10A is a sectional view along line Xa-Xa of a shaft member illustrated in FIG. 2B.
Figure 10B:
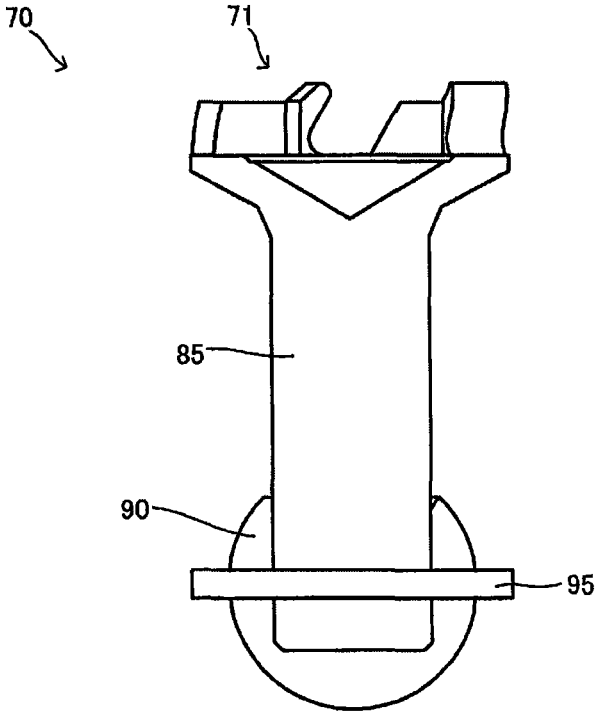
FIG. 10B is a sectional view along line Xb-Xb of the shaft member illustrated in FIG. 2B.

Returning to FIGS. 2A and 2B, the shaft member 70 in the end member 40 will be described. Respectively, FIG. 10A illustrates a sectional view along line Xa-Xa of the shaft member 70 illustrated in FIG. 2B, and FIG. 10B illustrates a sectional view along line Xb-Xb of the shaft member 70 illustrated in FIG. 2B. As can be ascertained from FIGS. 2B and 10, the shaft member 70 is provided with a coupling member 71, a rotating shaft 85, a spherical body 90, and the rotating force transmission pin 95.

Figure 11:
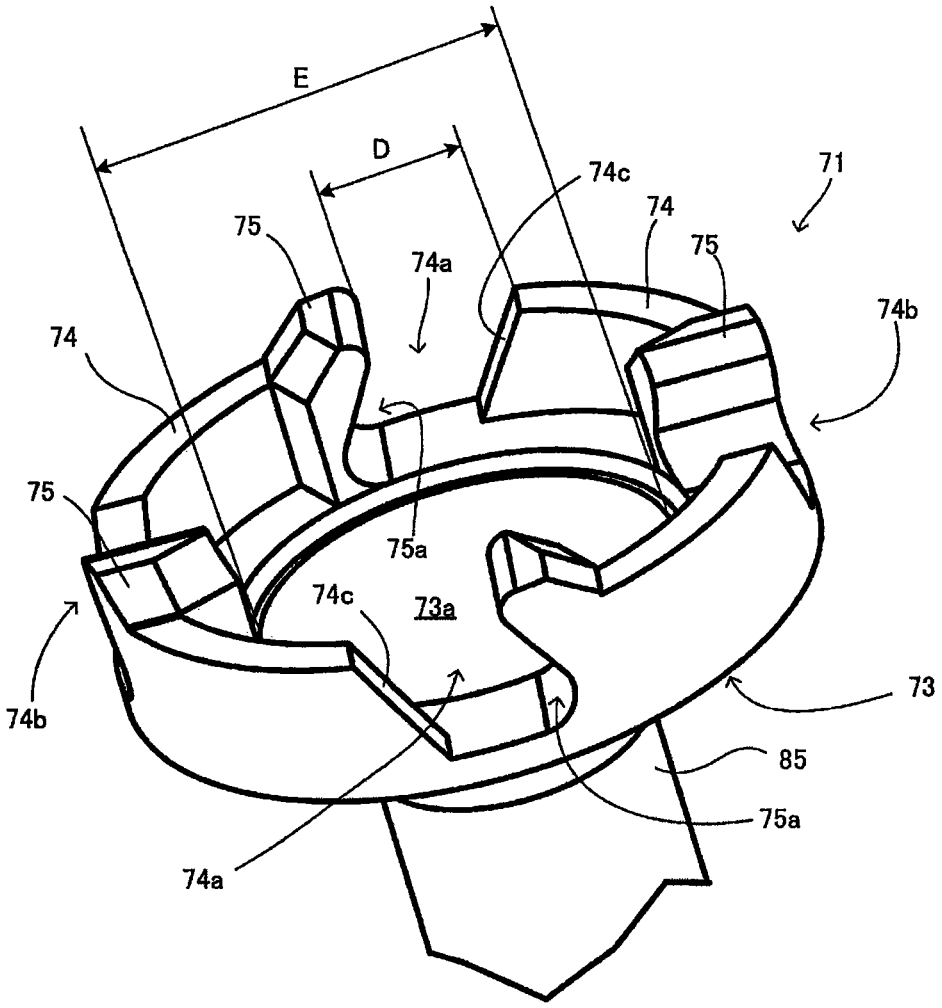
FIG. 11 is an enlarged view of a coupling member.

The coupling member 71 is a part which function as a rotating force receiving section that receives a rotational driving force from the apparatus body 10 (refer to FIG. 1). FIG. 11 illustrates an enlarged view of the coupling member 71. As can be ascertained from FIGS. 2B, 10, and 11, the coupling member 71 is a member which has a shape of a circular dish, and the inside thereof includes a bottom section 73 provided with a conical concave section 73*a* so that a part through which the axial line passes becomes the deepest part.

In addition, on a surface of the bottom section 73, a tubular engagement wall 74 stands along an edge of a surface on one surface side (a side opposite to a side on which the rotating shaft 85 is provided). Two grooves 74*a* and 74*b* which oppose each other by nipping the axial line of the shaft member 70 are provided in the engagement wall 74. One pair of grooves 74*a* and the other pair of grooves 74*b* are shifted by 90 degrees.

As illustrated in FIG. 11 well, in each groove 74*a* and 74*b*, a convex section 75 is provided on one side wall of the groove, and a hollow 75*a* is provided in a circumferential direction on the bottom section 73 side thereof. According to this, as will be described later, a pin 12, 12 of a drive shaft 11 of the apparatus body 10 is engaged with the hollow 75*a* and is prevented from falling out, and an appropriate rotating force is transmitted (refer to FIG. 17B).

In addition, inclined surfaces 74*c* are formed on a side walls on the other sides of each of the grooves 74*a* and 74*b*, and an introduction of the pin 12 into the groove is easily performed.

Therefore, a width of the groove 74*a* illustrated with D in FIG. 11 is slightly greater than a diameter of the pin 12 (refer to FIG. 17B) and is narrower than the drive shaft 11 so that the drive shaft 11 cannot pass therethrough. In addition, a diameter of the inside of the engagement wall 74 illustrated with E in FIG. 11 is formed to be slightly greater than a diameter of the drive shaft 11, but generally, is the same level as the diameter of the drive shaft 11. In which manner the rotating force can be received from the drive shaft 11 will be described later.

In the embodiment, four (two pairs) grooves of the engagement wall are provided, but the number thereof is not particularly limited, and may be two (one pair), six (three pairs), or more than six.

The rotating shaft 85 is a columnar shaft-like member which functions as a rotating force transmission section for transmitting the rotating force that the coupling member 71 receives. Therefore, the coupling member 71 is provided on one end of the rotating shaft 85.

The spherical body 90 functions as a base end section, and in the embodiment, as can be ascertained from FIGS. 10A and 10B, the spherical body 90 is a spherical member, and is provided in the end section on the side opposite to the side on which the coupling member 71 is disposed among the end sections of the rotating shaft 85. At this time, it is preferable that the axial line of the rotating shaft 85 and the center of the spherical body 90 match each other as much as possible. Accordingly, it is possible to obtain a stable rotation of the photoreceptor drum 35. In addition, the diameter of the spherical body 90 is generally the same as the narrowest part (in the embodiment, the narrowest part among intervals between the first groove-formed section 51 and the second groove-formed section 55) nipped by the holding section 50 of the bearing member 45. As apparently described above, the spherical body 90 does not regulate the movement of the shaft member 70 in a falling-out direction by the holding section 50 of the bearing member 45.

In the embodiment, a case where a normal sphere is used as the base end section is illustrated, but the invention is not limited thereto, and for example, a case where egg-shaped curved surfaces are combined with each other, may be employed.

The rotating force transmission pin 95 is a columnar shaft-like member which passes through the center of the spherical body 90, and in which both ends are disposed to protrude from the spherical body 90 through the spherical body 90. The axial line of the rotating force transmission pin 95 is provided to be orthogonal to the axial line of the rotating shaft 85.

A material of the shaft member 70 is not particularly limited, but a resin made of polyacetal, polycarbonate, or PPS can be used. However, in order to improve rigidity of the member, glass fibers, carbon fibers, or the like, may be mixed in the resin in accordance with a loading torque. In addition, rigidity may be further improved by inserting metal into the resin, or the entire member may be made of metal.

By combining the bearing member 45 and the shaft member 70 as follows, the end member 40 is made. Respectively, FIG. 12 is a sectional view in the axial line direction of the end member 40 along line illustrated with Xb-Xb in FIG. 2B, FIG. 13A is a posture in which the shaft member 70 is inclined at the most to one side from the same viewpoint as that of FIG. 12, and FIG. 13B is a posture in which the shaft member 70 is inclined at the most to the other side from the same viewpoint as that of FIG. 12.

Figure 12:
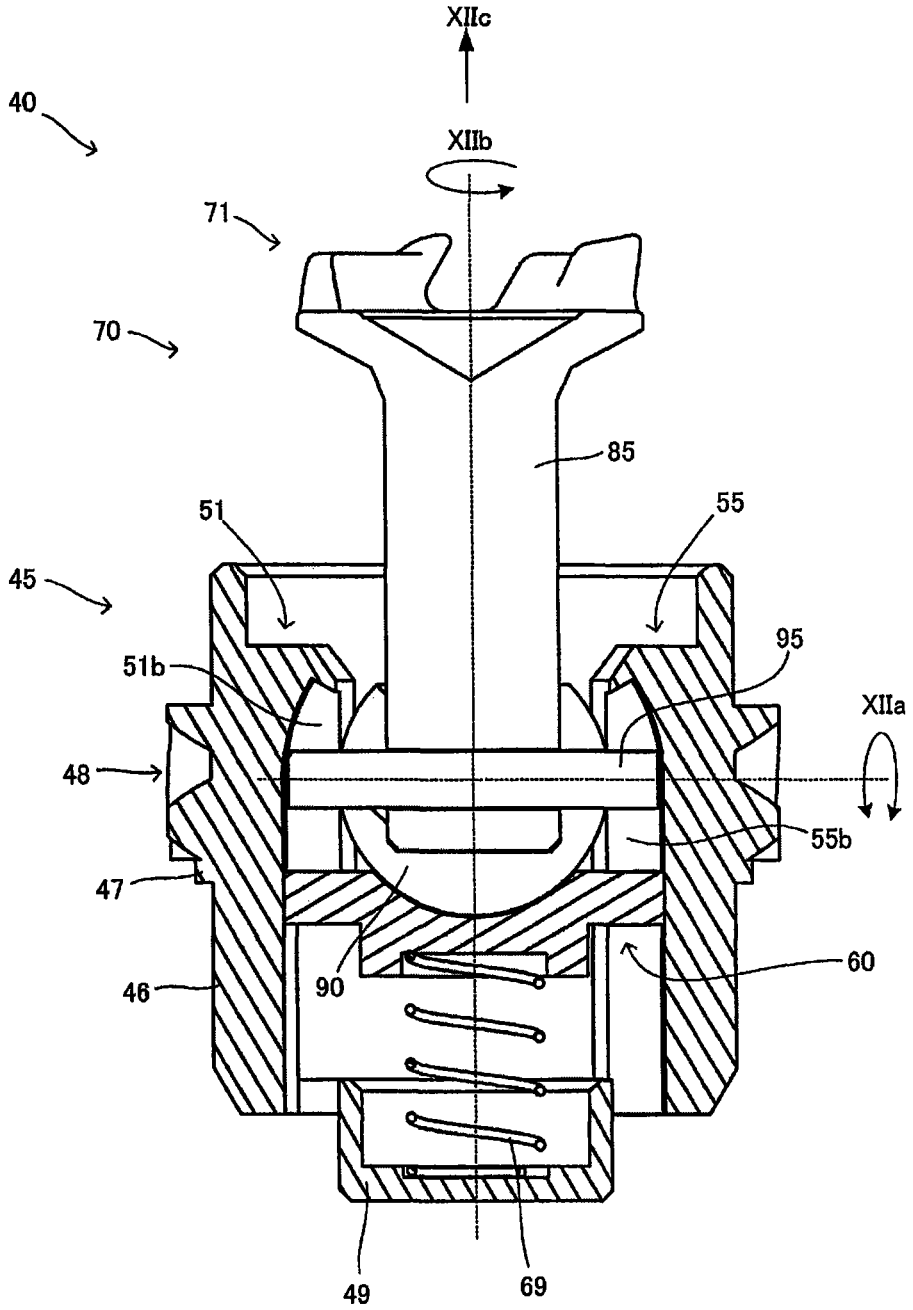
FIG. 12 is a sectional view in an axial direction of the end member along a line illustrated with Xb-Xb in FIG. 2B.

As can be ascertained from FIG. 12, the spherical body 90 of the shaft member 70 is disposed inside the space 50*a* (refer to FIGS. 7A and 8A) which is surrounded by the first groove-formed section 51, the second groove-formed section 55, and the movable base 60 of the holding section 50 in a posture of the movable base 60 of each B in FIGS. 5A to 8B, that is, in a posture in which the movable base 60 is separated from the receiving section 49 by the biasing force of the bias member 69 and approaches the opening side. Furthermore, both end sections of the rotating force transmission pin 95 which protrude from the spherical body 90 are inserted into the swing groove 51*b* of the first groove-formed section 51, and the swing groove 55*b* of the second groove-formed section 55. Accordingly, the shaft member 70 is held by the bearing member 45.

As the shaft member 70 is disposed inside the bearing member 45 in this manner, as illustrated with XIIa in FIG. 12, the shaft member 70 can rotate (swing) around the axial line of the rotating force transmission pin 95. In other words, the shaft member 70 can rotate (swing) in a front-back direction of the paper surface of FIG. 12 around the rotating force transmission pin 95.

Figure 13B:
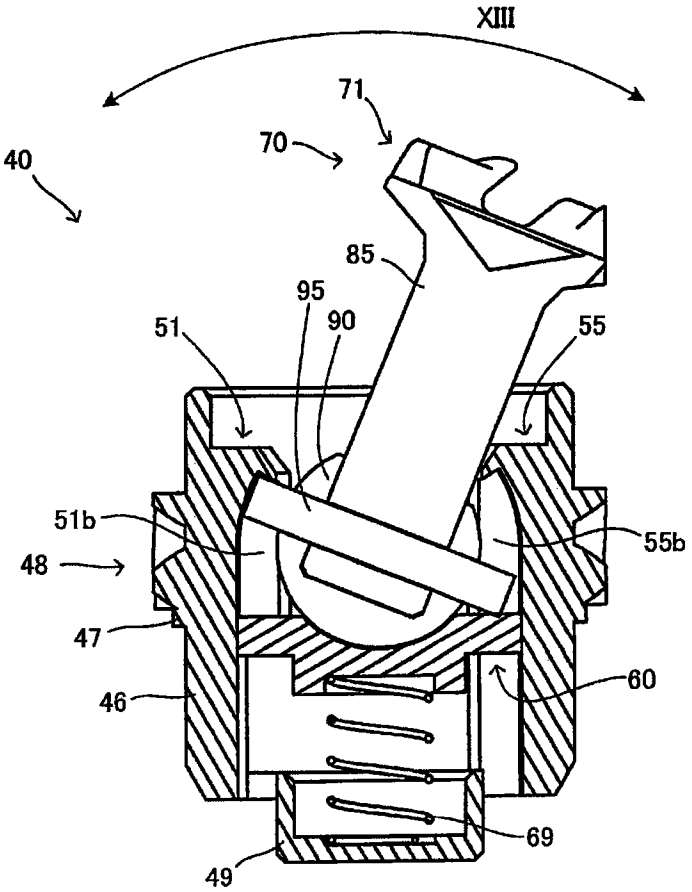
FIG. 13B is a view illustrating a posture in which the shaft member is inclined at the most to the other side from the same viewpoint as that of FIG. 12.
Figure 13A:
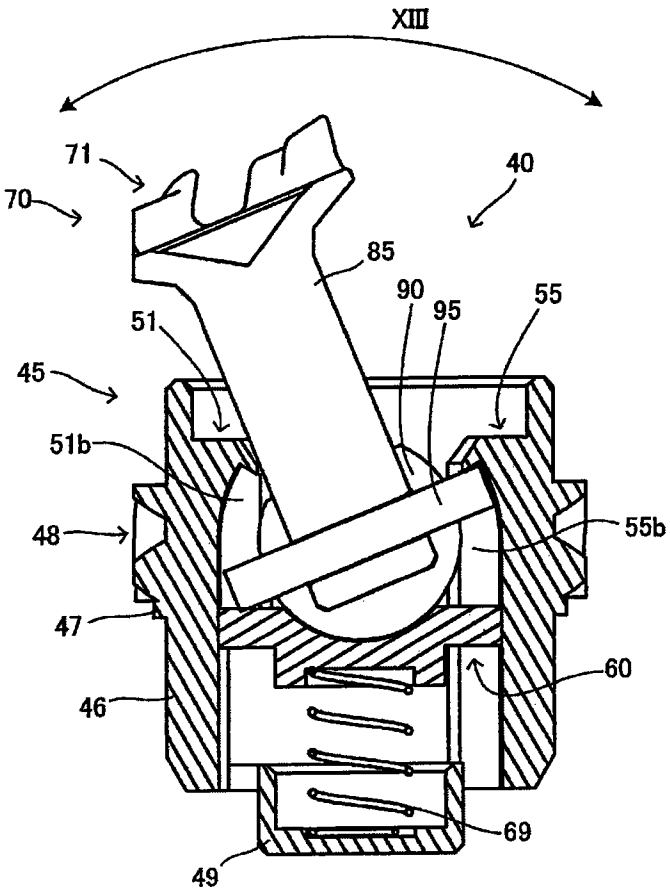
FIG. 13A is a view illustrating a posture in which the shaft member is inclined at the most to one side from the same viewpoint as that of FIG. 12.

Furthermore, as illustrated with XIII in FIGS. 13A and 13B, the shaft member 70 can rotate (swing) in a direction which is orthogonal to the rotation (swinging) illustrated with XIIa, that is, a direction in which the axial line itself of the rotating force transmission pin 95 swings. This is possible as both end sections of the rotating force transmission pin 95 respectively move in the swing grooves 51*b* and 55*b*. Here, since a part of the bottom surfaces 51*c* and 55*c* of the swing grooves 51*b* and 55*b* has circular arc surfaces 51*d* and 55*d*, even when the shaft member 70 swings as illustrated in FIGS. 13A and 13B, it is possible to suppress that the shaft member 70 moves to be largely swayed in the axial line direction and in a direction which is orthogonal to the axial line direction (horizontal direction on the paper surface of FIGS. 13A and 13B).

More specifically, the curved surfaces 51*d* and 55*d* of the swing grooves 51*b* and 55*b* have a shape of a circular arc as described above, and the center of the circular arc is a rotation center of the shaft member 70. In addition, it is preferable that a diameter of the circular arc generally matches the length of the rotating force transmission pin 95. Accordingly, it is possible to suppress that the shaft member 70 is swayed.

In addition, when receiving the driving force from the apparatus body 10, as illustrated with XIIb in FIG. 12, the shaft member 70 receives the rotating force around the axial line thereof. At this time, both end sections of the rotating force transmission pin 95 of the shaft member 70 can be hooked to groove side surfaces (groove side walls) of the swing groove 51*b* of the first groove-formed section 51 and the swing groove 55*b* of the second groove-formed section 55, and transmit the rotating force to the bearing member 45, and then, to the photoreceptor drum 35.

Furthermore, a case where the shaft member 70 receives a force in a direction of coming off (falling out) from the bearing member 45 as illustrated with XIIc in FIG. 12 is considered. However, the bottom sections of the swing grooves 51*b* and 55*b* have the curved surfaces 51*d* and 55*d* as described above, an interval therebetween becomes narrower toward the opening section (upper side of the paper surface of FIG. 12, and an end section on a side opposite to the receiving section 49), and the interval becomes narrower than the length of the rotating force transmission pin 95. Therefore, even when the shaft member 70 is pulled in the axial direction in this manner, since the rotating force transmission pin 95 is hooked to the curved surface 51*d* in the bottom surface 51*c* of the swing groove 51*b*, and the curved surface 55*d* in the bottom surface 55*c* of the swing groove 55*b*, the shaft member 70 is not disengaged from the bearing member 45. As apparently described above, the movement of the shaft member 70 in the axial direction is regulated by the rotating force transmission pin 95.

In addition, when the shaft member 70 is in a posture of transmitting the rotating force as illustrated in FIGS. 12 and 13 in this manner, in a case where a side in which the shaft member 70 is inserted in the bearing member 45 is considered as an upper side, at least a part of the rotating force transmission pin 95 is located above the introduction grooves 51*a* and 55*a*. In other words, in the bearing member 45, where the side in which the shaft member 70 is inserted in the bearing member 45 is considered as an upper side, in a posture in which the shaft member 70 transmits the rotating force, the introduction grooves 51*a* and 55*a* are disposed entirely at a position to be lower than the entirety or a part of the rotating force transmission pin 95. In the embodiment, further, the movable base 60 is in a posture of each B of FIGS. 5A to 8B, and the introduction grooves 51*a* and 55*a* are hidden by the movable base 60. Therefore, since the rotating force transmission pin 95 cannot go into the introduction grooves 51*a* and 55*a*, the shaft member 70 does not unintentionally come off from the bearing member 45, or the swinging as illustrated in FIGS. 13A and 13B is not inhibited. Therefore, it is possible to prevent the shaft member 70 from unintentional falling out, and to allow the shaft member 70 to smoothly swing. In addition, in the embodiment, since the introduction grooves 51*a* and 55*a* are hidden in the postures of FIGS. 12 and 13, even when the introduction grooves 51*a* and 55*a* are disposed on an upstream side in the rotating direction around the shaft, and even when the introduction grooves 51*a* and 55*a* are disposed on a downstream side in the rotating direction around the shaft, there is no concern that the shaft member 70 comes off. In other words, in the embodiment, the introduction groove may be in the first convex sections 52 and 56 (refer to FIGS. 5A and 6A), and the introduction groove may be in the second convex sections 53 and 57 (refer to FIGS. 5A and 6A).

Figure 14:
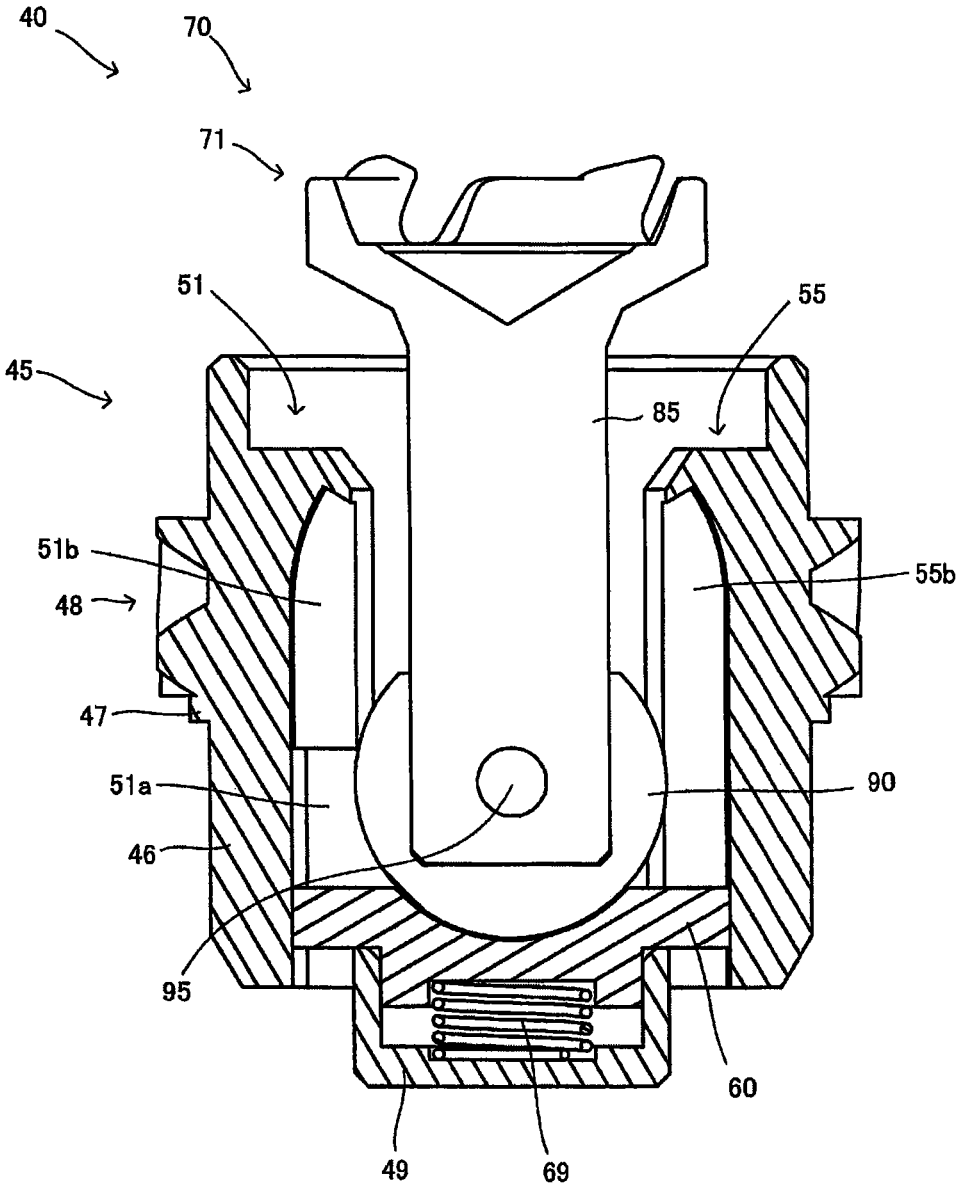
FIG. 14 is one view illustrating a method of attaching the shaft member to the bearing member.
Figure 15A:
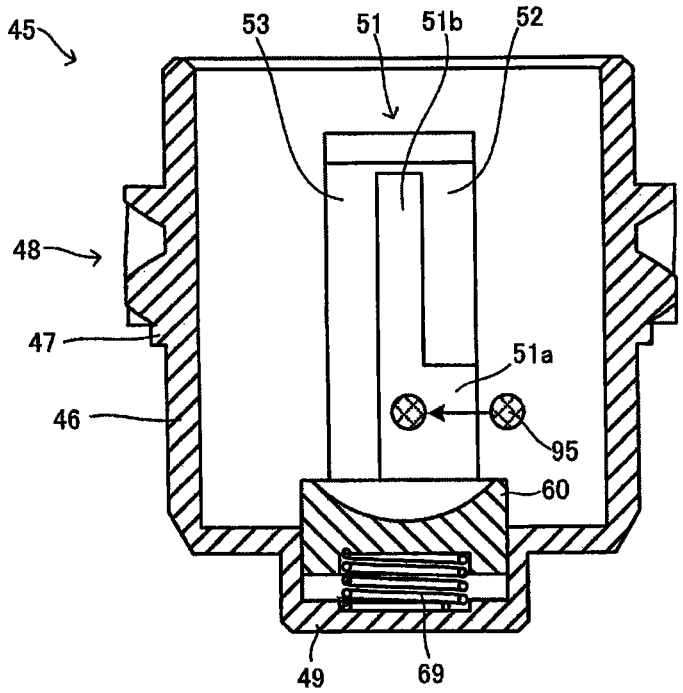
FIG. 15A is a view illustrating a situation in which a rotating force transmission pin moves in an introduction groove in a first groove-formed section.
Figure 15B:
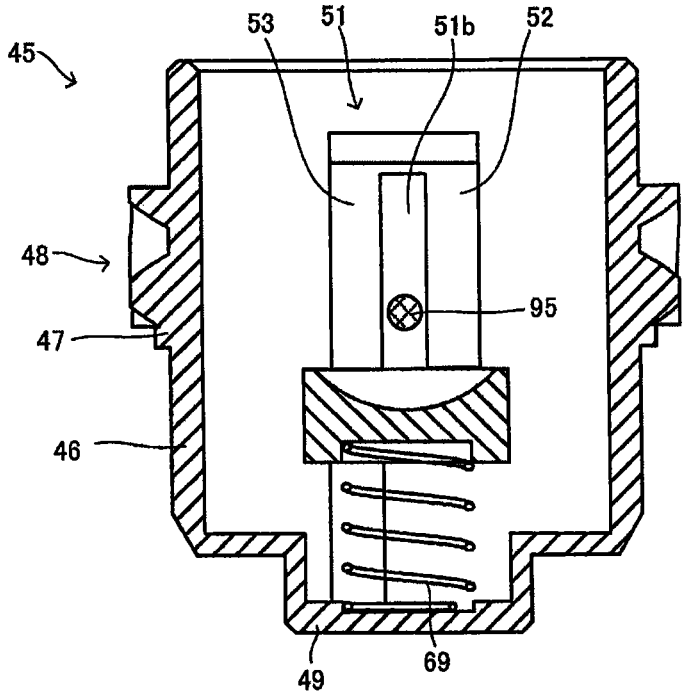
FIG. 15B is a view illustrating a situation in which the rotating force transmission pin moves an swing groove in the first groove-formed section.
Figure 16A:
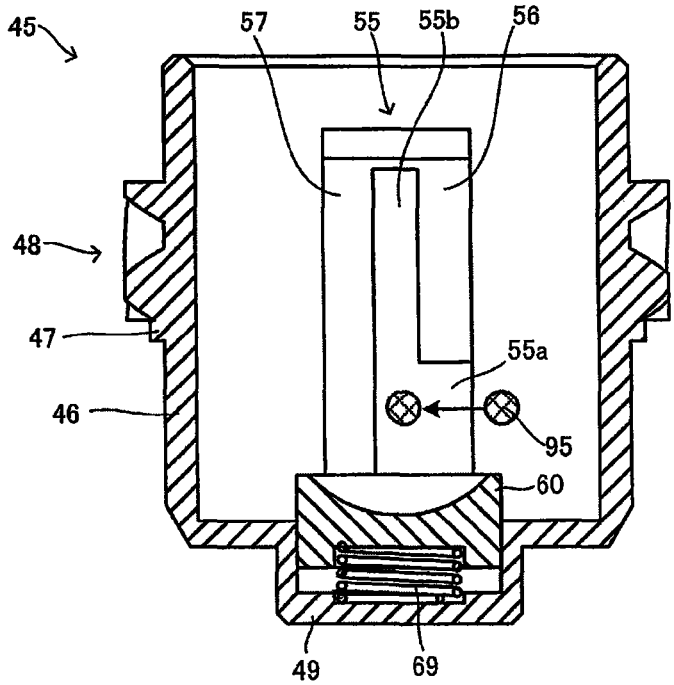
FIG. 16A is a view illustrating a situation in which a rotating force transmission pin moves in an introduction groove in a second groove-formed section.
Figure 16B:
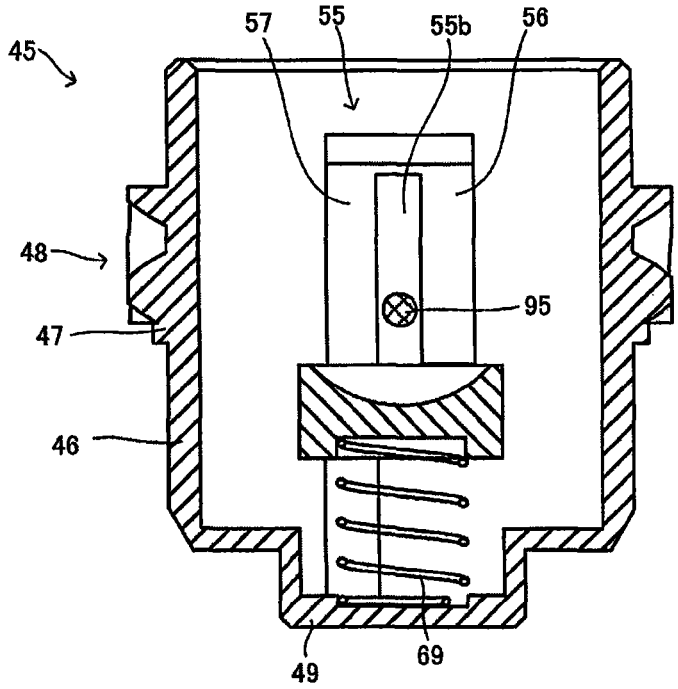
FIG. 16B is a view illustrating a situation in which the rotating force transmission pin moves an swing groove in the second groove-formed section.

Next, a method of combining the shaft member 70 with the bearing member 45 will be described. FIGS. 14 to 16 illustrate views for the description. FIG. 14 is a sectional view in the axial direction illustrating a situation when the shaft member 70 is attached to the bearing member 45. FIGS. 15A to 16B are diagrams illustrating the movement of the rotating force transmission pin 95 when being attached, and views illustrating a position of the rotating force transmission pin 95 with a hatched round mark. FIGS. 15A and 15B focus on the first groove-formed section 51, and FIGS. 16A and 16B focus on the second groove-formed section 55.

FIGS. 15A and 16A illustrate a situation where the rotating force transmission pin 95 moves in the introduction grooves 51*a* and 55*a*, and FIGS. 15B and 16B respectively illustrate a situation where the rotating force transmission pin 95 moves in the swing grooves 51*b* and 55*b*.

First, as illustrated in FIG. 14, the spherical body 90 side of the shaft member 70 is inserted to the inside from the opening side of the tubular body 46 of the bearing member 45 so that the rotating force transmission pin 95 is on the outside of the first groove-formed section 51 and the second groove-formed section 55. At this time, the movable base 60 is pressed in the axial direction by the shaft member 70, compressed against the biasing force of the bias member 69, and moves the movable base 60 to approach the receiving section 49. Accordingly, as illustrated in each A of FIGS. 14, and 5 to 8, the introduction grooves 51*a* and 55*a* of the first groove-formed section 51 and the second groove-formed section 55 are illustrated largely on a side opposite to the side on which the bias member 69 is disposed in the movable base 60.

Next, the shaft member 70 is rotated around the shaft from the above-described posture. Then, as illustrated in FIGS. 15A and 16A, the end sections of the rotating force transmission pin 95 which protrude from the spherical body 90 respectively move in the introduction grooves 51*a* and 55*a*, and moves into the swing grooves 51*b* and 55*b* from the outside of the first groove-formed section 51 and the second groove-formed section 55.

Accordingly, when the end section of the rotating force transmission pin 95 reaches the inside of the introduction grooves 51*a* and 55*a*, as illustrated in FIGS. 15B and 16B, by eliminating or weakening a pressing force which is loaded to the shaft member 70, the bias member 69 extends by the biasing force, and the movable base 60 moves to be separated from the receiving section 49. According to this, the shaft member 70 also moves. At this time, the end section of the rotating force transmission pin 95 moves inside the introduction grooves 51*a* and 55*a*.

Accordingly, a posture illustrated in FIG. 12 is made.

As described above, according to the bearing member 45, it is possible to attach the bearing member 45 without forcibly pulling in and out the shaft member 70. In addition, removing the shaft member 70 from the bearing member 45 may be performed in a procedure opposite to the above, and it is possible to easily remove the shaft member 70, and to smoothly perform reusing and recycling.

In addition, attachment of the shaft member 70 to the bearing member 45 can be performed after attaching the bearing member 45 to the photoreceptor drum 35. Therefore, it is also possible to avoid the attachment of the end member to the photoreceptor drum in a comparatively stable state where there is a swing member. In other words, for example, the end member 40 can be attached to the photoreceptor drum 35 as follows.

In the end member 40, first, the bearing member 45 is fitted to the photoreceptor drum 35. At this time, since the swinging (rotating) shaft member 70 is not attached to the bearing member 45, it is possible to push the bearing member 45 into the photoreceptor drum 35 easily and stably. After this, the shaft member 70 is attached to the bearing member 45 which is attached to the end section of the photoreceptor drum 35. The attachment of the shaft member 70 can also be easily performed as described above, and can be performed without pushing the shaft member 70 with a large amount of force. Therefore, when combining the shaft member and the bearing member to each other, it is not necessary to bend the bearing member.

By the end member 40, when mounting the process cartridge 20, it is possible to impart an appropriate rotating force to the photoreceptor drum 35, and to easily attach and detach the process cartridge 20.

Returning to FIG. 1, description of the process cartridge 20 will be continued. The charging roller, the developing roller, the developing blade, the transfer roller, and the cleaning blade which are other configuration elements which are provided inside the housing 21 of the process cartridge 20, are elements as follows.

The charging roller charges the photoreceptor drum 35 by applying a voltage from the apparatus body 10. Charging is performed as the charging roller rotates following the photoreceptor drum 35, and comes into contact with the outer circumferential surface of the photoreceptor drum 35.

The developing roller is a roller which supplies a developer to the photoreceptor drum 35. In addition, by the developing roller, an electrostatic latent image which is formed in the photoreceptor drum 35 is developed. In addition, the developing roller has a fixed magnet embedded therein.

The developing blade is a blade which adjusts an amount of the developer which adheres to the outer circumferential surface of the developing roller, and imparts a frictional electrification charge to the developer itself.

The transfer roller is a roller for transferring the image which is formed in the photoreceptor drum 35 to the recording medium, such as a paper sheet.

The cleaning blade is a blade which comes into contact with the outer circumferential surface of the photoreceptor drum 35 and eliminates the developer that remains after transferring by the tip end thereof.

Each of the rollers is stored inside the housing 21 to be rotatable. In other words, each roller realizes functions thereof by rotating as necessary inside the housing 21.

Here, in the shaft member 70 of the photoreceptor-drum unit 30, at least the coupling member 71 is disposed to be exposed from the housing 21. Accordingly, as will be described later, it is possible to obtain the rotational driving force from the apparatus body 10, and attaching and detaching the apparatus body 10 and the process cartridge 20 becomes easy.

Here, each roller and blade provided in the process cartridge 20 is described, but the members provided here are not limited thereto, and it is preferable that the members, parts, and developers which are generally provided in other process cartridges are provided.

Next, the apparatus body 10 will be described. The apparatus body 10 of the embodiment is a laser printer. In the laser printer, an operation is performed in a posture in which the process cartridge 20 is mounted, and when an image is formed, the photoreceptor drum 35 is rotated, and charging is performed by the charging roller. In this state, the photoreceptor drum 35 is irradiated with laser light which corresponds to image information by using various optical members provided here, and an electrostatic latent image based on the image information is obtained. The latent image is developed by the developing roller.

Meanwhile, the recording medium, such as the paper sheet, is set in the apparatus body 10, and transported to a transfer position by a feeding roller or a transporting roller, which is provided in the apparatus body 10. The transfer roller is disposed at the transfer position, a voltage is applied to the transfer roller as the recording medium passes, and the image is transferred to the recording medium from the photoreceptor drum 35. After this, the image is fixed to the recording medium as heat and pressure are applied to the recording medium. In addition, the recording medium on which the image is formed is discharged from the apparatus body 10 by a discharging roller or the like.

In this manner, in the posture in which the process cartridge 20 is mounted, the apparatus body 10 imparts the rotational driving force to the photoreceptor-drum unit 30. Here, description will be made of manner that the rotational driving force is imparted to the photoreceptor-drum unit 30 from the apparatus body 10 in the posture in which the process cartridge 20 is mounted.

Figure 17A:
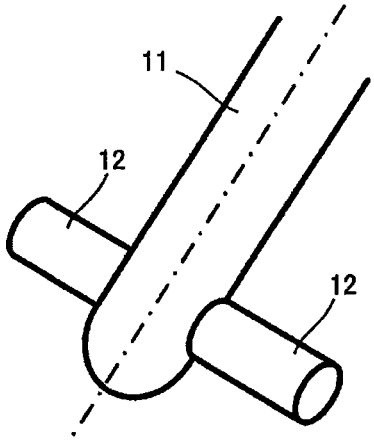
FIG. 17A is a perspective view illustrating a drive shaft of an image forming apparatus body, a pin, and the drive shaft.

The rotational driving force to the process cartridge 20 is imparted by the drive shaft 11 which serves as a rotating force imparting section of the apparatus body 10. FIG. 17A illustrates a shape of a tip end section of the drive shaft 11. As can be ascertained from FIG. 17A, the tip end of the drive shaft 11 is a columnar shaft member which is a hemispherical surface, and the columnar pin 12 which serves as the rotating force imparting section that protrudes in a direction which is orthogonal to an axial line of rotation illustrated with one-dot chain line is provided. On the side opposite to the tip end side illustrated in FIG. 17A of the drive shaft 11, a gear row is formed so as to make it possible to rotate the drive shaft 11 around the axial line, and according to this, the gear row is connected to a motor which is a driving source.

In addition, with respect to a moving direction for attaching and detaching the process cartridge 20 to and from the apparatus body 10 as illustrated in FIG. 1, the drive shaft 11 is disposed to protrude on a track of the movement of attaching and detaching generally at a right angle. In addition to this, the drive shaft 11 only rotates without moving in the axial line direction. Therefore, in attaching and detaching the process cartridge 20, it is necessary to engage and disengage the shaft member 70 to and from the drive shaft 11. In addition, according to the end member 40, engaging and disengaging the shaft member 70 to and from the drive shaft 11 becomes easy. A specific aspect of attaching and detaching will be described later in detail.

Figure 17B:
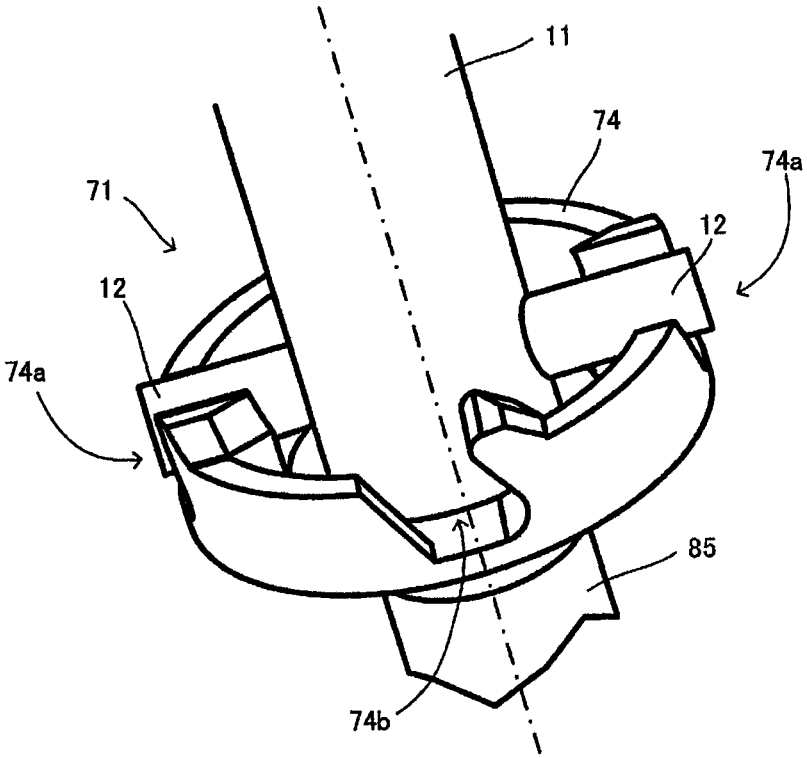
FIG. 17B is a view illustrating a posture in which the pin is linked to the coupling member.

In a posture in which the process cartridge 20 is mounted on the apparatus body 10, the drive shaft 11 and the coupling member 71 of the shaft member 70 of the end member 40 are engaged with each other, and the rotating force is transmitted. FIG. 17B illustrates a situation in which the coupling member 71 of the end member 40 is engaged with the drive shaft 11. As can be ascertained from FIG. 17B, in a posture in which the drive shaft 11 and the coupling member 71 are engaged with each other, the axial line of the drive shaft 11 and the axial line of the coupling member 71 are disposed to be abutted against each other so that the axial lines match each other. At this time, the pin 12 of the drive shaft 11 is disposed inside the groove 74*a* and the groove 74*b* that oppose each other in the coupling member 71 (in FIG. 17B, a case where the pin 12 is disposed inside the groove 74*a*). Accordingly, the coupling member 71 rotates following the rotation of the drive shaft 11, and the photoreceptor-drum unit 30 rotates.

Accordingly, a posture in which the rotating force is transmitted is a posture in which the axial lines of the drive shaft 11 and the coupling member 71 are disposed coaxially, and the pins 12 and 12 are inside the grooves 74*a* and 74*a* or the grooves 74*b* and 74*b* of the coupling member 71.

Figure 18A:
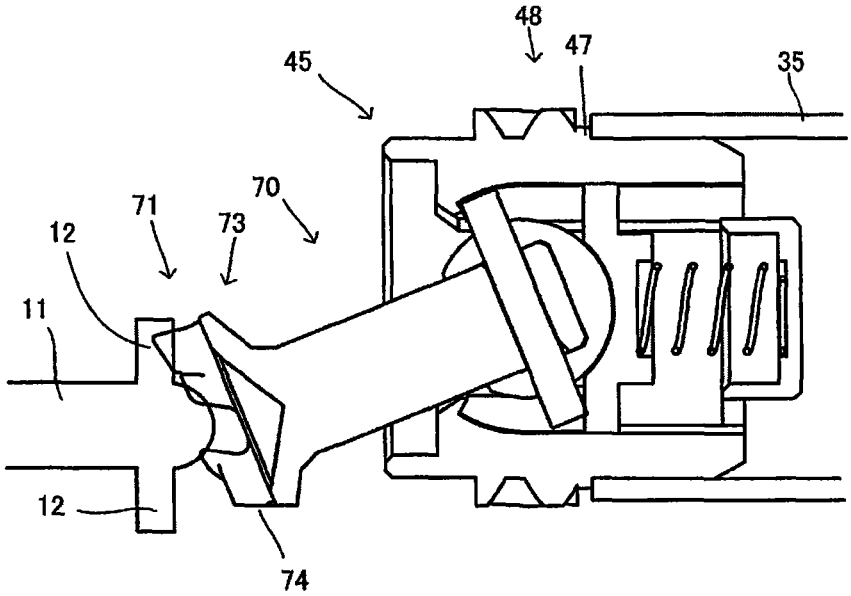
FIG. 18A is a view illustrating an example of one situation in which a process cartridge is mounted on an apparatus body.
Figure 18B:
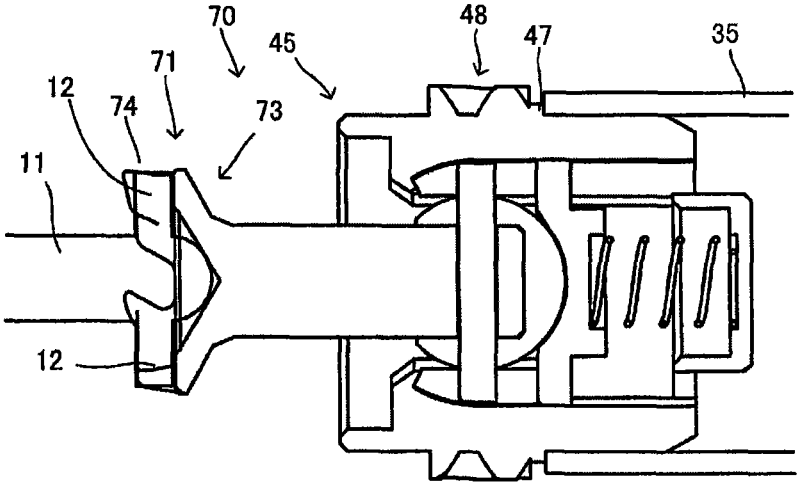
FIG. 18B is a view illustrating an example of another situation in which the process cartridge is mounted on the apparatus body.

Next, examples of operations of the drive shaft 11 and the photoreceptor-drum unit 30 when the process cartridge 20 is mounted on the apparatus body 10 will be described. FIGS. 18A and 18B are explanation views. FIG. 18A is a diagram illustrating one situation in which the end member 40 is engaged with the drive shaft 11. FIG. 18B is a diagram illustrating another situation in which the end member 40 is engaged with the drive shaft 11. In FIGS. 18A and 18B, an order of the operations is illustrated in FIGS. 18A and 18B, and right and left on a paper surface is an orientation which becomes the axial line direction. In addition, this is a situation in which the process cartridge 20 is moved to a lower part on the paper surface and mounted.

First, as illustrated in FIG. 18A, a posture in which the coupling member 71 of the shaft member 70 is inclined to the drive shaft 11 side is obtained. It is preferable that this posture is a posture in which the shaft member 70 is inclined at the most. When moving the process cartridge 20 to the lower part on the paper surface from this posture, the tip end of the drive shaft 11 comes into contact with the inside of the bottom section 73 of the coupling member 71 or the engagement wall 74 being hooked thereto. When the process cartridge 20 is further pushed into the apparatus body 10, the drive shaft 11 which comes into contact with the coupling member 71 being hooked thereto rotates to exceed the inclined shaft member 70. In addition, the pins 12 and 12 are inserted to the inside of the grooves 74*a* and 74*a*.

Furthermore, by pushing the process cartridge 20 in a mounting direction, as illustrated in FIG. 18B, a posture in which the axial line of the inclined shaft member 70 and the axial line of the drive shaft 11 match each other, and the axial lines of the drive shaft 11, the shaft member 70, the bearing member 45, and the photoreceptor drum 35 match each other is obtained as illustrated in FIG. 18B. Accordingly, the rotating force is appropriately imparted to the shaft member 70, the bearing member 45, and the photoreceptor drum 35 from the drive shaft 11, and the rotating force is finally imparted to the process cartridge 20.

Meanwhile, operations of the drive shaft 11 and the photoreceptor-drum unit 30 when detaching the process cartridge 20 from the apparatus body 10 may retrace the above-described order.

As described above, it is possible to detach the process cartridge 20 from the apparatus body 10 to be pulled out in a direction different from the axial line direction of the drive shaft 11 of the apparatus body 10, and to mount the process cartridge 20 on the apparatus body 10 to be pushed into the apparatus body 10.

Figure 19A:
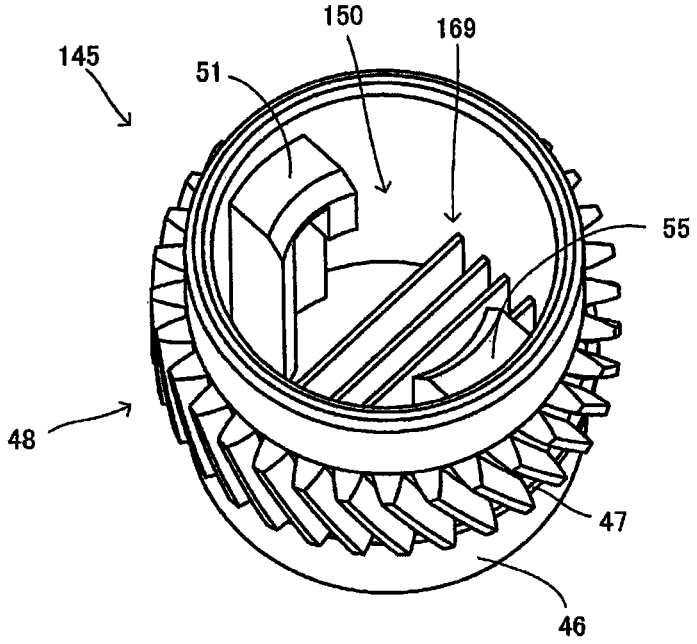
FIG. 19A is a perspective view of a bearing member according to another embodiment.
Figure 19B:
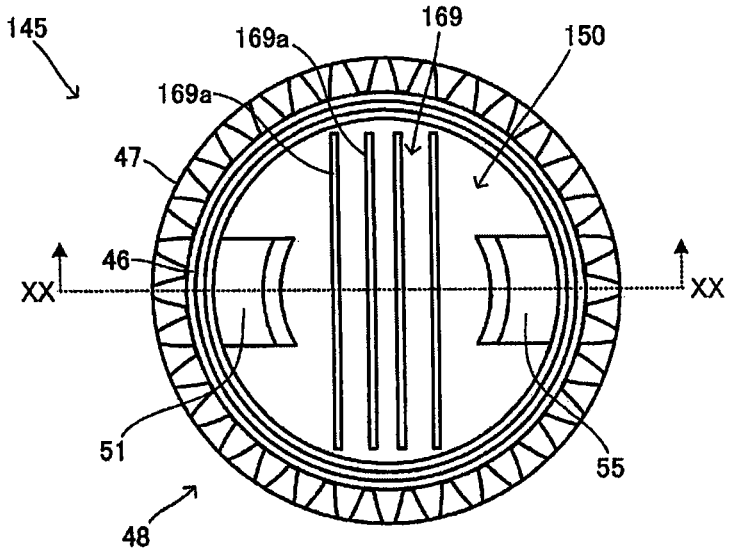
FIG. 19B is a view when the bearing member is viewed from a direction in which the shaft member is inserted in the axial direction.
Figure 20:
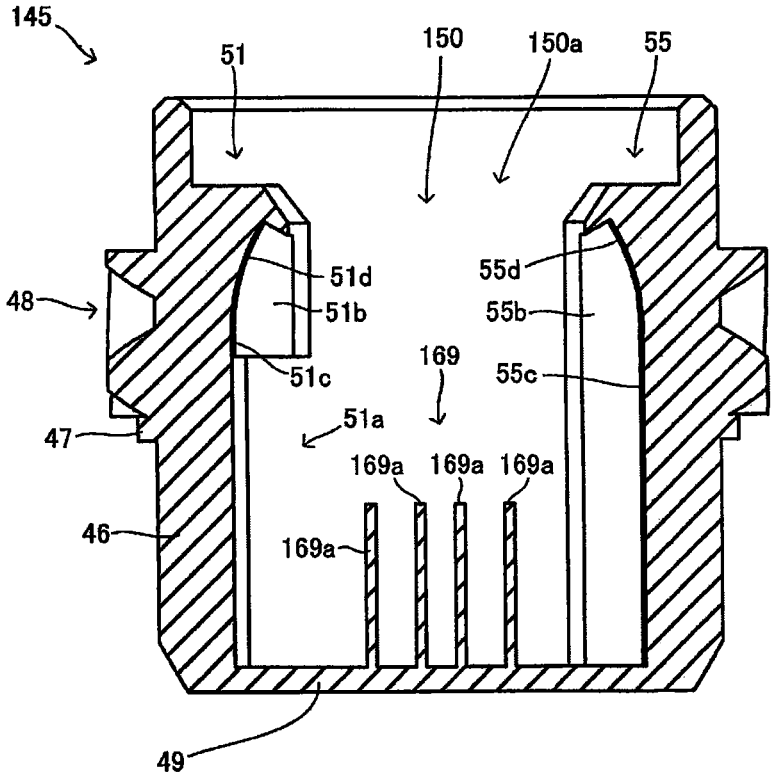
FIG. 20 is an arrow sectional view along line XX-XX illustrated in FIG. 19B.

FIGS. 19A, 19B and 20 are diagrams illustrating another embodiment. FIG. 19A is a perspective view of a bearing member 145. FIG. 19B is a diagram when the bearing member 145 is viewed from a direction in which the shaft member 70 is inserted in the axial direction. FIG. 20 is an arrow sectional view along line XX-XX illustrated in FIG. 19B.

In the embodiment, in the bearing member 145 which configures an end member 140, the embodiment of a holding section 150 is different from the holding section 50 of the bearing member 45. Therefore, here, the holding section 150 will be described.

The holding section 150 is a part for forming the predetermined introduction grooves 51*a* and 55*a*, and the swing grooves 51*b* and 55*b* inside the tubular body 46, and include the first groove-formed section 51 and the second groove-formed section 55. Furthermore, the holding section 150 does not include the movable base, and is provided with a bias member 169. Here, the first groove-formed section 51 and the second groove-formed section 55 are similar to the bearing member 45, and the description thereof will be omitted.

The bias member 169 is means which can bias the tubular body in the axial direction, and biases the shaft member 70 in the axial direction when the shaft member 70 is combined with the bearing member 145. In the embodiment, as can be ascertained from FIGS. 19A, 19B, and 20, in the bias member 169, four rubber plates 169*a* are aligned to oppose a surface at a predetermined interval. The rubber plates 169*a* are configured to stand in the axial direction from the inner surface of the tubular body 46 in the receiving section 49 so that the plate surface is in the axial direction, like a rib. Here, the number of rubber plates 169*a* is not particularly limited.

In the embodiment, the rubber plates 169*a* are formed of elastic rubber, but may be formed of other materials if the material is an elastic member. Examples thereof can include a plate made of resin or metal.

In addition, in the embodiment, the rubber plates 169*a* stand and are used like a rib, but the invention is not limited thereto, and a shape which can be elastically deformed can be employed.

According to the bias member 169, it is possible to directly bring the shaft member 70 into contact with the bias member 169 as will be described later, and to reduce the number of components.

In this manner, the holding section 150 is configured to form a space (space 150*a*) which is surrounded by the first groove-formed section 51, the second groove-formed section 55, and the bias member 169, as illustrated with 150*a* in FIG. 20. The spherical body 90 of the shaft member 70 is disposed in the space 150*a*.

Figure 21:
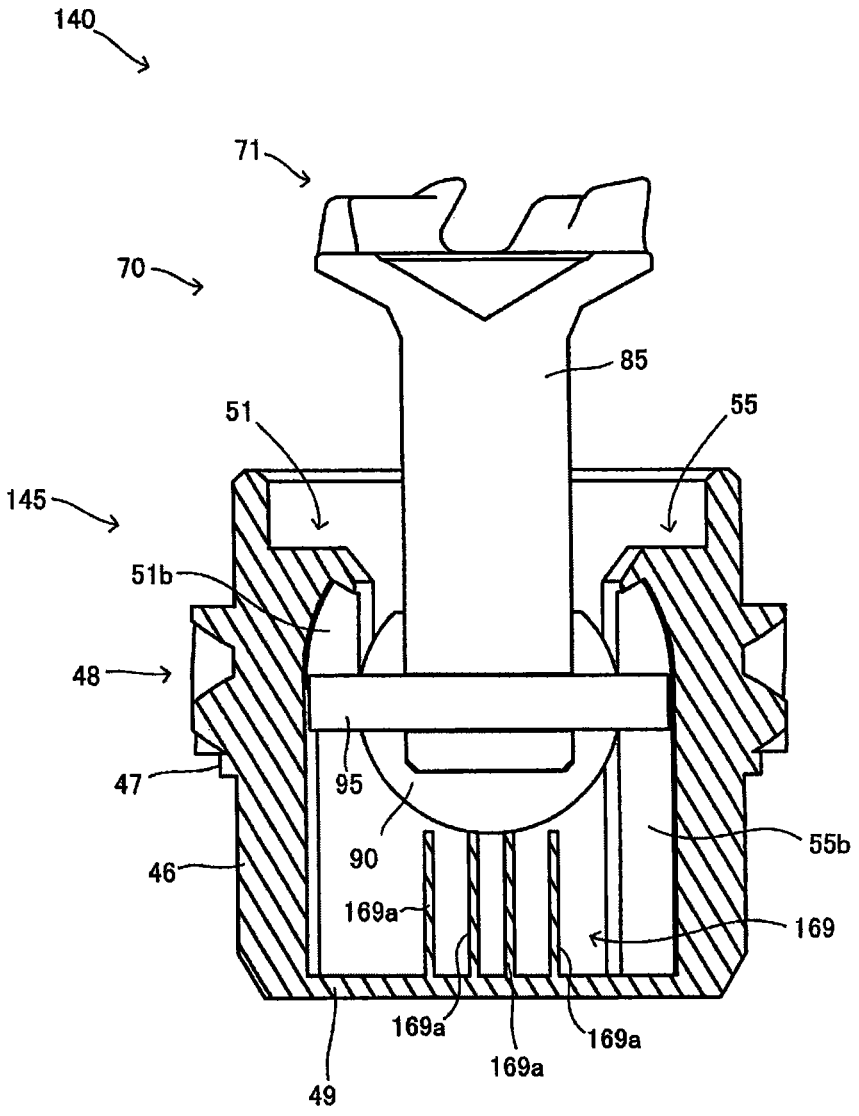
FIG. 21 is a sectional view of the end member in the axial direction, which corresponds to FIG. 12.

The end member 140 is made by combining the bearing member 145 and the shaft member 70 to each other as follows. FIG. 21 is a sectional view in the axial direction of the end member 140, and corresponds to FIG. 12. As can be ascertained from FIG. 21, the shaft member 70 is mounted and comes into contact with a tip end of the rubber plate 169*a* of the bias member 169, and is disposed in the space 150*a* (refer to FIG. 20). Furthermore, both end sections of the rotating force transmission pin 95 which protrude from the spherical body 90 are inserted into the swing groove 51*b* of the first groove-formed section 51, and the swing groove 55*b* of the second groove-formed section 55. Accordingly, the shaft member 70 is held by the bearing member 145. The rotation of the bearing member 145 by the swinging of the shaft member 70 and the rotation of the shaft member 70 are as described with the end member 40.

In addition, when the shaft member 70 is in a posture of transmitting the rotating force as illustrated in FIG. 21, in a case where a side in which the shaft member 70 is inserted in the bearing member 145 is considered as an upper side, at least a part of the rotating force transmission pin 95 is above the introduction grooves 51*a* and 55*a*. In other words, in the bearing member 145, where the side in which the shaft member 70 is inserted in the bearing member 145 is considered as an upper side, in a posture in which the shaft member 70 transmits the rotating force, the introduction grooves 51*a* and 55*a* are disposed entirely at a position to be lower than the entirety or a part of the rotating force transmission pin 95. Therefore, since the rotating force transmission pin 95 cannot go into the introduction grooves 51*a* and 55*a*, the shaft member 70 does not unintentionally come off from the bearing member 145. Therefore, it is possible to prevent the shaft member 70 from unintentional falling out, and to allow the shaft member 70 to smoothly swing. However, in the embodiment, as can also be ascertained from FIG. 21, there is a case where a part of the rotating force transmission pin 95 is disposed to overlap with a part of the introduction grooves 51*a* and 55*a* from the viewpoint of FIG. 21. Therefore, in order to reliably prevent the shaft member 70 from unintentionally coming off from the bearing member 145, it is preferable that the introduction grooves 51*a* and 55*a* are provided on the upstream side in the rotating direction around the shaft.

Figure 22:
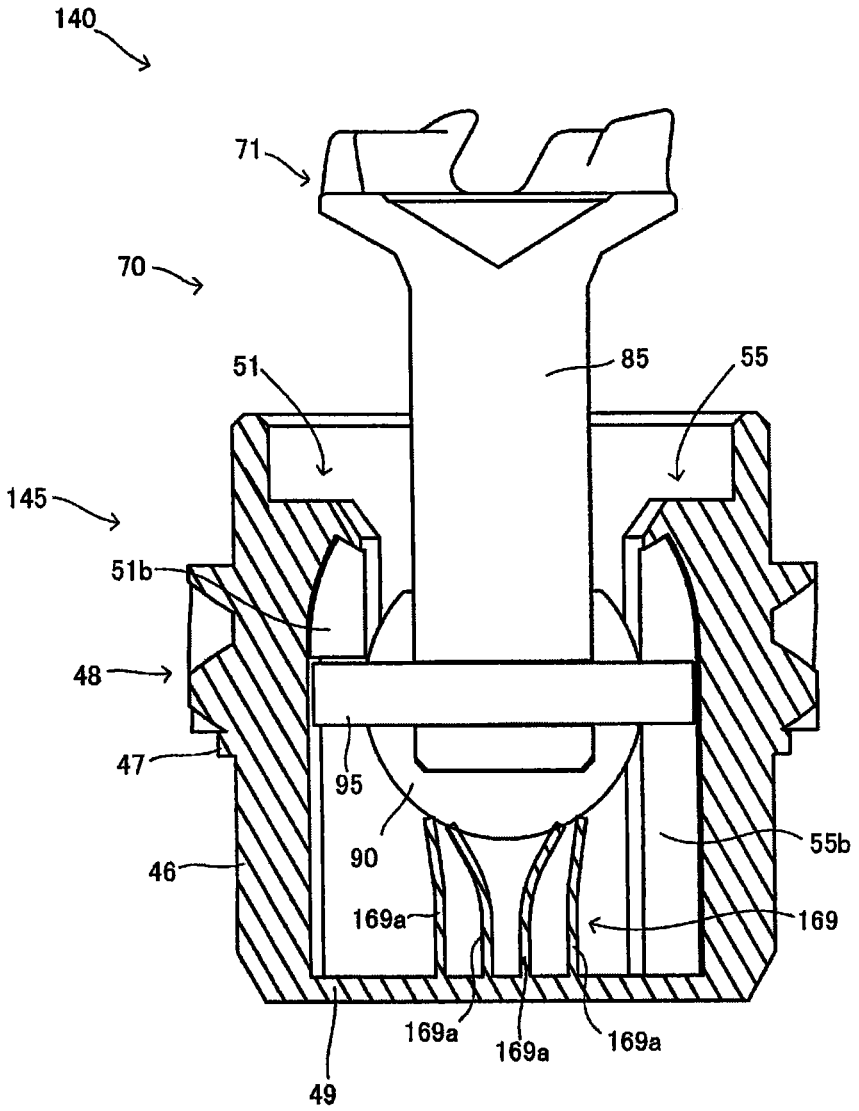
FIG. 22 is a view illustrating a method of attaching the shaft member to the bearing member from the same viewpoint as that of FIG. 21.

Next, a method of combining the shaft member 70 with the bearing member 145 will be described. FIG. 22 illustrates a view for the description. FIG. 22 is a sectional view in the axial direction illustrating a situation when the shaft member 70 is attached to the bearing member 145. First, the spherical body 90 side of the shaft member 70 is inserted to the inside from the opening side of the tubular body 46 of the bearing member 145 so that the rotating force transmission pin 95 is on the outside of the first groove-formed section 51 and the second groove-formed section 55 (refer to FIG. 14). At this time, the elastic member 169 is pressed in the axial direction by the shaft member 70, a force is applied against the biasing force of the bias member 169, and the bias member 169 is deformed as illustrated in FIG. 22. Accordingly, as can be ascertained from FIG. 22, a height at which the rotating force transmission pin 95 can be inserted into the introduction grooves 51*a* and 55*a* of the first groove-formed section 51 and the second groove-formed section 55 is made.

After this, the shaft member 70 is rotated around the shaft similarly to the end member 40, and the tip end of the rotating force transmission pin 95 is disposed in the swing grooves 51*b* and 55*b* following the examples in FIGS. 15A, 16A, 15B, and 16B.

As described above, by the bearing member 145, the similar effects to those of the bearing member 45 are also achieved. In addition, if the embodiment in which the bias member of the embodiment has a shape of a rib, and stands in the axial direction is employed, at this part, a so-called undercut section regarding the axial direction is not formed. For this reason, it is also possible to mold the bearing member by integrally combining bearing member with other parts. According to this, advantageous effects are also achieved from the viewpoint of manufacturing cost.

Figure 23:
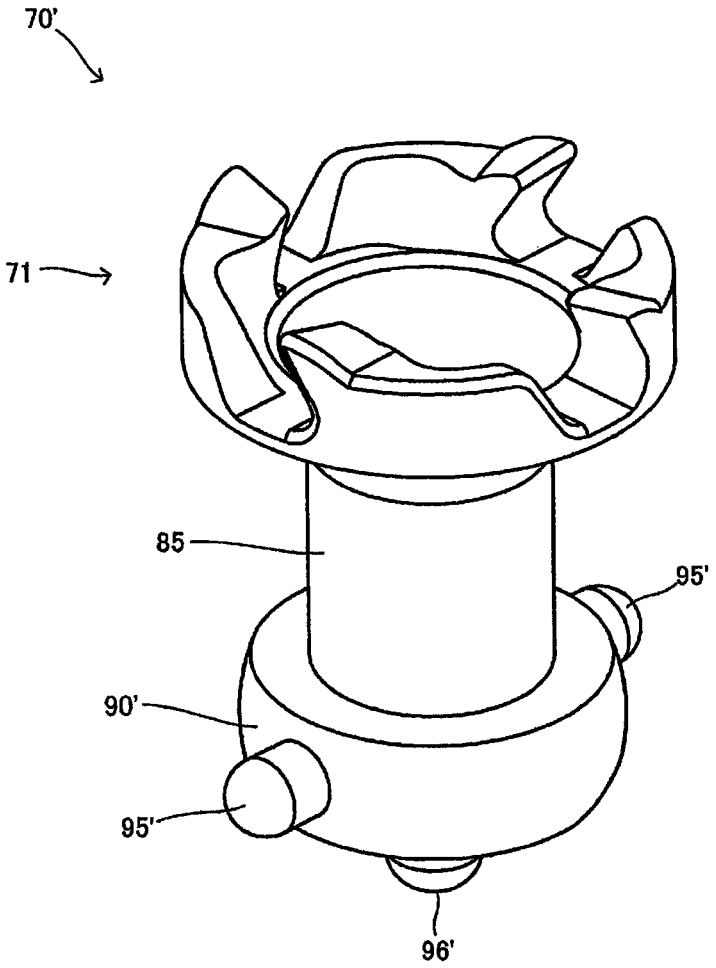
FIG. 23 is a perspective view of the shaft member in the end member according to another embodiment.

FIG. 23 is a diagram illustrating still another embodiment, and is a perspective view of a shaft member 70'. The shaft member 70' is provided with the coupling member 71, the rotating shaft 85, a disk 90', a rotating force transmission pin 95', and a supporting shaft 96'.

The disk 90' is a member having a shape of a disk which functions as a base end section, and is provided in an end section on a side opposite to a side where the coupling member 71 is disposed in the end section of the rotating shaft 85 on one surface thereof. At this time, it is preferable that an axial line of the rotating shaft 85 and an axial line of the disk 90' match each other as much as possible. Accordingly, it is possible to obtain stable rotation of the photoreceptor drum 35. In addition, a side surface of the disk 90' is a spherical surface, and a diameter of the disk 90' is generally the same as the interval between the first groove-formed section 51 and the second groove-formed section 55 of the holding section 50 of the above-described bearing member 45.

The rotating force transmission pin 95' is a member having a columnar shaft which passes through the axial line of the disk 90' being parallel to the direction of the plate surface of the disk 90', which penetrates the disk 90', and in which both ends thereof are disposed to protrude from the outer circumferential surface of the disk 90'. The axial line of the rotating force transmission pin 95' is provided to be orthogonal to the axial line of the rotating shaft 85.

The supporting shaft 96' is a columnar member which functions as a base end section that stands from the plate surface on a side where the rotating shaft 85 is disposed on the plate surface of the disk 90', and tip end thereof is formed in a hemispherical shape. Accordingly, the tip end of the supporting shaft 96' abuts against the movable base 60 of the bearing member 45, and stable rotation (swinging) can be obtained.

Similarly to the shaft member 70, the shaft member 70' can also be attached to the bearing member 45, and rotation (swinging) which is similar to that described above is possible.

According to the present invention, there are provided a bearing member, an end member, a photoreceptor-drum unit, and a process cartridge which are easily handled.

What is claimed is:

1. An end member comprising:

a shaft member comprising a rotating force transmission pin; and a bearing member, wherein the bearing member is disposed at an end section of a photoreceptor drum for attaching the shaft member that transmits a rotating force to the bearing member, the bearing member comprising:

a tubular body; and a holding section which is disposed inside the tubular body attachably and detachably, and holds a rotating force transmission pin provided in the shaft member, wherein the holding section includes at least two swing grooves provided extending along an axial direction of the tubular body, and opposing each other, and introduction grooves, each having one end communicating with the swing groove and the other end communicating with an outside of the swing groove, wherein the holding section includes a bias member of which one end side is attached to the tubular body, and which can be biased in the axial direction, and wherein, where a side in which the shaft member is inserted in the bearing member is considered as an upper side, the introduction grooves in a posture in which the shaft member transmits the rotating force are disposed entirely at a position to be lower than an entirety or a part of the rotating force transmission pin, and wherein the shaft member is prevented from being removed from the bearing member as the rotating force transmission pin of the shaft member is hooked to the swing grooves of the hearing member.

2. The end member according to claim 1, wherein the bias member is a coil spring.

3. The end member according to claim 1, wherein the bias member is an elastic rubber.

4. The end member according to claim 1, wherein a movable base is disposed on the other end side of the bias member, and the movable base can move in the axial direction of the tubular body.

5. The end member according to claim 1 wherein the shaft member includes a rotating shaft, a rotating force receiving section which is provided on one end side of the rotating shaft, is engageable with a rotating force imparting section of an image forming apparatus body, and receives a rotating force from a drive shaft in an engaged posture, a base end section which is disposed on the other end side of the rotating shaft, and the rotating force transmission pin which has an end section that protrudes from the base end section, wherein the shaft member is combined with the bearing member as the rotating force transmission pin of the shaft member is disposed in the swing groove of the bearing member, and wherein, where aside in which the shaft member is inserted in the bearing member is considered as an upper side, at least a part of the rotating force transmission pin in a posture in which the shaft member transmits the rotating force is disposed above the introduction grooves.

6. The end member according to claim 5, movement of the shaft member in an axial direction is regulated by the rotating force transmission pin.

7. The end member according to claim 5, wherein, in the base end section, movement of the shaft member in a falling-out direction in the axial direction is regulated by the bearing member.

8. A photoreceptor-drum unit comprising:

a photoreceptor drum; and the end member as defined in claim 5.

9. A process cartridge comprising the photoreceptor-drum as defined in claim 8, wherein a shaft member is attachable to and detachable from a drive shaft of an image forming apparatus.

10. An end member comprising:

a shaft member comprising a rotating force transmission pin; and a bearing member comprising:

a tubular body; and a holding section which is disposed inside the tubular body attachably and detachably, and holds a rotating force transmission pin provided in the shaft member, wherein the holding section includes at least two swing grooves provided extending along an axial direction of the tubular body undo each other, and introduction grooves, each having one end communicating with the swing groove and the end communicating with an outside of the swing groove, wherein the holding section includes a bias member of which one end side is attached to the tubular body, and which can be biased in the axial direction, and wherein, where a side in which the shaft member is inserted in the baring member is considered as an upper side, the introduction grooves in a posture in which the shaft member transmits the rotating force are disposed entirely at a position to be lower than an entirety or a part of the rotating force transmission pin wherein the shaft member includes a rotating shaft, a rotating force receiving section which is provided on one end side of the rotating shaft, is engageable with a rotating force imparting section of an image forming apparatus body, and receives a rotating force from a drive shaft in an engaged posture, a base end section which is disposed at the other end side of the rotating shaft, and a rotating force transmission pin which has an end section that protrudes from the base end section, wherein the shaft member is combined with the bearing member and the base end section is disposed being in contact with a movable base as the rotating force transmission pin of the shaft member is disposed in the swing groove of the bearing member, and wherein, where a side in which the shaft member is inserted in the bearing member is considered as an upper side, at least a part of the rotating force transmission pin in a posture in which the shaft member transmits the rotating force is disposed above the introduction grooves.

11. The end member according to claim 10, movement of the shaft member in an axial direction is regulated by the rotating force transmission pin.

12. The end member according to claim 10, wherein, in the base end section, movement of the shaft member in a falling-out direction in the axial direction is regulated by the bearing member.

13. A photoreceptor-drum unit comprising:

a photoreceptor drum; and the end member as defined in claim 10.

14. A process cartridge comprising the photoreceptor-drum unit as defined claim 13, wherein a shaft member is attachable to and detachable from a drive shaft of an image forming apparatus.

* * * * *